US007911413B2

(12) United States Patent
Choi

(10) Patent No.: US 7,911,413 B2
(45) **Date of Patent: *Mar. 22, 2011**

(54) METHOD OF DRIVING PLASMA DISPLAY PANEL

(75) Inventor: Jeong Pil Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 762 days.

This patent is subject to a terminal disclaimer.

(21) Appl. No.: 11/357,953

(22) Filed: Feb. 22, 2006

(65) Prior Publication Data

US 2006/0139246 A1 Jun. 29, 2006

Related U.S. Application Data

(63) Continuation of application No. 10/310,801, filed on Dec. 6, 2002, now Pat. No. 7,012,579.

(30) Foreign Application Priority Data

Dec. 7, 2001 (KR) ..... 10-2001-77382
Mar. 18, 2002 (KR) ..... 10-2002-14501
Apr. 4, 2002 (KR) ..... 10-2002-18545
Apr. 22, 2002 (KR) ..... 10-2002-21870

(51) Int. Cl.
*G09G 3/28* (2006.01)

(52) U.S. Cl. ..... 345/60

(58) Field of Classification Search ..... None
See application file for complete search history.

(56) References Cited

U.S. PATENT DOCUMENTS 6,144,349 A 11/2000 Awata et al. ..... 345/67
6,320,560 B1 11/2001 Sasaki et al. ..... 345/60
6,362,799 B1 3/2002 Ueoka et al. ..... 345/60
6,483,251 B2 * 11/2002 Setoguchi et al. ..... 315/169.4
6,653,994 B2 11/2003 Takeda et al. ..... 345/60
6,768,478 B1 * 7/2004 Wani et al. ..... 345/60
6,784,859 B2 8/2004 Setoguchi et al. ..... 345/60
7,012,579 B2 * 3/2006 Choi ..... 345/60

FOREIGN PATENT DOCUMENTS

JP 06-289811 A 10/1994
JP 11-133913 5/1999
JP 2001-093424 A 4/2001
JP 2001-184023 7/2001
JP 2001-282185 10/2001
JP 2001-318645 11/2001
JP 2002-072957 A 3/2002
JP 2003-084712 3/2003
JP 2003-157041 5/2003
KR 10-2002-0092486 A 12/2002
KR 10-2003-0014097 A 2/2003
KR 10-2003-0022948 A 3/2003

OTHER PUBLICATIONS

Japanese Office Action Dated Feb. 21, 2006.

(Continued)

*Primary Examiner* — Sumati Lefkowitz
*Assistant Examiner* — Tammy Pham
(74) *Attorney, Agent, or Firm* — KED & Associates LLP

(57) ABSTRACT

Disclosed is a method of driving a plasma display panel enabling to improve an overall contrast characteristic of the plasma display panel by reducing a voltage difference between scan and sustain electrodes Y and Z to decrease an emission amount of light generated by a discharge between the scan and sustain electrodes Y and Z. The present invention includes a first step of applying a reset pulse to the scan electrode to form predetermined wall charges on the electrodes for a set-up period and a second step of applying a pulse of a predetermined level to the sustain electrode to reduce a voltage difference between the scan and sustain electrodes while the reset pulse is applied.

17 Claims, 19 Drawing Sheets

OTHER PUBLICATIONS

Korean Office Action dated Feb. 18, 2004 in Application No. 10-2001-0077382.
Korean Office Action dated Mar. 31, 2004 in Application No. 10-2001-0018545.
Korean Office Action dated Apr. 13, 2004 in Application No. 10-2001-0021870.
Korean Office Action dated May 11, 2004 in Application No. 10-2001-0014501.

* cited by examiner

METHOD OF DRIVING PLASMA DISPLAY PANEL

CROSS-REFERENCE TO RELATED APPLICATIONS

This is a Continuation Application of prior application Ser. No. 10/310,801 filed Dec. 6, 2002 now U.S. Pat. No. 7,012,579 whose entire disclosure is incorporated herein by reference. Further, this application claims the benefit of the Korean Application Nos. P2001-77382 filed on Dec. 7, 2001, P2002-14501 filed on Mar. 18, 2002, P2002-18545 filed on Apr. 4, 2002 and P2002-21870 filed Apr. 22, 2002, which are hereby incorporated by reference.

BACKGROUND OF THE INVENTION

1. Field of the Invention

The present invention relates to a plasma display panel, and more particularly, to a method of driving a plasma display panel enabling to improve a contrast characteristic of the plasma display panel.

2. Discussion of the Related Art

Generally, a plasma display panel (hereinafter abbreviated PDP) is a device that displays images including characters or graphics by making phosphors emit light by a UV-ray radiating from the discharge of inert mixed gases (He+Xe, Ne+Xe, or He+Xe+Ne).

Such a PDP is advantageous in thinning its thickness and widening its screen size, and provides a greatly improved quality of image due to the recent development of technology.

It is typical that the PDP including 3-electrodes is driven by AC voltage. And, such a PDP is called an AC surface discharge type PDP.

In a 3-electrodes AC surface discharge type PDP, wall charges are accumulated on a surface on discharge of the PDP and the electrodes are protected from sputtering generated from discharge. Hence, the 3-electrodes AC surface discharge type PDP has advantages of low-voltage drive and long endurance.

A discharge cell of a 3-electrodes AC surface type PDP according to a related art includes scan and sustain electrodes Y and Z on a front substrate and an address electrode X on a back substrate. In this case, the address electrode X extends in a direction crossing with the scan and sustain electrodes Y and Z.

A front dielectric layer and a protective layer are stacked on the front substrate having the scan and sustain electrodes Y and Z running in parallel with each other. Besides, wall charges generating from the plasma discharge are accumulated on the front dielectric layer.

The protective layer prevents the front dielectric layer caused by the sputtering generated from the plasma discharge as well as increases a discharge efficiency of secondary electrons. And, the protective layer is generally formed of MgO.

Meanwhile, a back dielectric layer and a barrier rib are formed on the back substrate having the address electrode X. And, phosphors are coated on surfaces of the back dielectric layer and barrier rib.

The barrier rib lies in parallel with the address electrode X to prevent optical or electric interference between adjacent cells on the back substrate. Namely, the barrier rib prevents UV and visible rays, which are generated from the discharge, from leaking into the adjacent discharge cells.

The phosphors are excited by a UV-ray emitted from the discharge to emit a red, green, or blue visible ray. Inert mixed gases (He+Xe, Ne+Xe, or He+Xe+Ne) are injected in a discharge space provided between the two substrates and barrier rib.

The above-explained discharge cell has the electrodes arranged like a matrix form. A plurality of scan electrodes Y1 to Ym and a plurality of sustain electrodes Z1 to Zm are arranged in parallel with each other in discharge cells. And, the discharge cell is provided on each of intersections between the two parallel electrodes Y1 to Ym and Z1 to Zm and address electrodes (X1 to Xn).

The scan electrodes Y1 to Ym are driven sequentially, while the sustain electrodes are driven I common. And, the address electrodes X1 to Xn are divided into odd and even lines to drive.

A drive time for representing a specific gray scale for a single frame in such a 3-electrodes AC surface discharge type PDP is separated into a plurality of sub-fields. And, light emission in proportion to a weight of a video data is carried out during each sub-field duration to perform the gray scale.

FIG. 1 illustrates a constructional diagram of a frame in accordance with a PDP drive according to a related art.

Referring to FIG. 1, a single frame according to a drive of a 3-electrodes AC surface discharge type PDP is divided into a plurality of sub-fields by time. Specifically, a single frame is divided into various sub-fields differing in the number of light emissions to drive with time-division.

Each of the sub-fields SF is divided into a reset period for resetting an entire screen, an address period for selecting a scan electrode line and selecting discharge cells on the selected scan electrode line, and a sustain period representing a gray scale according to the discharge number for the discharge cells selected by an address discharge.

For instance, when an image is displayed with 256 gray scales using 8 bits video data, as shown in FIG. 1, a frame period (16.67 ms) corresponding to 1/60 second is divided into eight sub-fields SF1 to SF8. Each of the eight sub-fields is driven for the reset period, address period, and sustain period. In this case, the reset and address periods are set up to have the same rate for each of the sub-fields. On the other hand, the sustain period of each of the sub-fields is given thereto with a time weight having a rate of $2^N$(where N=0, 1, 2, 3, 4, 5, 6, and 7). Namely, the sustain periods increase with the rates of 1:2:4:8:16:32:64:128 from the first sub-field SF1 to the eighth sub-field SF8, respectively.

FIG. 2 illustrates a diagram of a drive waveform according to a PDP drive in the frame in FIG. 1, in which 'Y', 'Z', and 'X' indicate scan, sustain, and address electrodes, respectively.

Referring to FIG. 2, each sub-field of a PDP according to a related art is divided into a reset period for resetting an entire screen, an address period for selecting a cell, and a sustain period for maintaining a discharge of the selected cell to drive.

The reset period is separated into a set-up period and a set-down period. A reset pulse having a ramp-up waveform is simultaneously applied to scan electrodes during the set-up period, and the other reset pulse having a ramp-down waveform is applied thereto during the set-down period.

During the set-up period SU of the reset period, the rest pulse RP of the ramp-up waveform is applied to the scan electrodes Y. And, a set-up discharge occurs in the discharge cells of the entire screen by the reset pulse RP of the ramp-up waveform Positive(+) wall charges are then accumulated on the address and sustain electrodes X and Z by the set-up discharge, while negative(−) wall charges are piled up on the scan electrodes Y.

Subsequently, the reset pulse −RP of the ramp-down waveform is applied to the scan electrodes Y during the set-down period SD. The reset pulse −RP of the ramp-down waveform has a waveform descending from a positive voltage lower than a peak voltage of the reset pulse RP of the ramp-up waveform after the reset pulse R P of the ramp-up waveform is applied thereto.

The reset pulse −RP of the ramp-down waveform brings about a weak erase discharge (i.e. set-down discharge) in the discharge cells to erase the wall charges, which are piled up on the respective electrodes X, Y, and Z excessively, in part as well as unnecessary charges in space charges. Hence, the wall charges amounting to the extent that enables the set-down discharge to trigger stably the address discharge remain in the discharge cells uniformly.

Wile the reset pulse −RP of the ramp-down waveform is applied to the scan electrodes Y, a positive(+) DC (direct current) voltage DCSC is applied to the sustain electrodes Z. Namely, at the time point that the reset pulse −RP of the ramp-down waveform is applied, the positive(+) DC voltage DCSC starts being applied to the sustain electrodes Z. And, the DC voltage DCSC is maintained until the rest pulse −RP of the ramp-down waveform reaches a negative(−) reset-down voltage Vrd, and is kept being applied during the subsequent address period.

While the DC voltage DCSC is applied to the sustain electrodes Z during the address period, a negative(−) scan pulse SP is applied to the scan electrodes Y and a positive(+) data pulse DP synchronized with the negative(−) scan pulse SP is applied to the address electrodes X.

As a voltage difference between the scan pulse SP and the data pulse DP is added to the voltage by the wall charges generated from the reset period, an address discharge occurs in the discharge cell supplied with the data pulse DP.

In the discharge cells selected by the address discharge, wall charges enough to generate the discharge are formed when the sustain voltage is applied thereto.

In order to generate a sustain discharge from the discharge cell selected by the address discharge, sustain pulses SUSPy and SUSPz are applied to the scan and sustain electrodes Y and Z alternately.

In the discharge cell selected by the address discharge, a sustain discharge, i.e. display discharge, is generated between the scan and sustain electrodes Y and Z whenever the sustain pulses SUSPy and SUSPz are applied thereto as the voltages by the sustain pulses SUSPy and SUSPz are added to a wall voltage causes by the wall charges in the discharge cell.

After completion of the sustain discharge, an erase pulse of a ramp wavelength (not shown in the drawing) having a small pulse width and a voltage level is applied to the sustain electrode Z to erase the wall charges remaining in the cells of the entire screen.

When the erase pulse is applied to the sustain electrode Z, a voltage difference between the sustain and scan electrodes Z and Y increases gradually to bring about weak discharges between the sustain and scan electrodes Z and Y consecutively. In this case, the weak discharge erases the wall charges existing in the cells where the sustain discharge has occurred.

However, the PDP according to the related art decreases its contrast characteristic since the wall charges are excessively formed on the scan and sustain electrodes Y and Z during the reset period.

Such a problem is fully explained in detail by referring to FIG. 3. FIG. 3 illustrates a diagram of wall charge formation of set-up and set-down periods according to a square waveform in FIG. 2.

First of all, when the reset pulse RP of the ramp-up waveform applied to the scan electrodes Y is applied during the set-up period SU, the set-up discharge occurs in the discharge cells of the entire screen. Hence, as shown in a part A, the negative(−) wall charges are formed on the scan electrodes Y while the positive(+) wall charges are formed on the sustain and address electrodes Z and X.

Subsequently, since the polarities of the wall charges formed on the respective electrodes are inversed by the reset pulse −RP of the ramp-down waveform applied to the scan electrodes Y and the positive(+) DC voltage DCSC applied to the sustain electrodes Z during the set-down period, the wall charges generated excessively and irregularly, as shown in part B, are reduced to a predetermined quantity.

After the end of the reset period, the negative(−) scan pulse SP applied to the scan electrodes Y and the positive(+) data pulse DP applied to the address electrodes X for synchronization with the scan pulse SP reciprocally are added to the voltage generated by the wall charges accumulated previously during the set-down period SD, whereby the address discharge occurs in the discharge cell supplied with the data pulse DP.

In this case, the discharge between the scan and sustain electrodes Y and Z is generated at a voltage lower than that between the scan and address electrodes Y and X. Thus, an emission amount of light proceeding toward an observer exceeds that of the other light generated by the discharge between the scan and address electrodes Y and X, whereby the emission amount of the light for the reset and address periods as the non-display period of gray scale increases. Hence, the contrast characteristic is degraded as much as the increment of the emission amount of the light.

In order to prevent the degradation of the contrast characteristic, it is preferable that the address discharge as the non-display discharge between the scan and address electrodes Y and X is generated in a vertical direction. Yet, as the voltage difference between the scan and sustain electrodes Y and Z is added to the voltage of the wall charges generated for the reset period, the discharge is generated between the scan and sustain electrodes Y and Z in a surface direction. Therefore, the degradation of the contrast characteristic is inevitable since the light by the discharge generated between the scan and sustain electrodes Y and Z in the surface direction is barely generated from the entire area of the discharge cell.

SUMMARY OF THE INVENTION

Accordingly, the present invention is directed to a method of driving a plasma display panel that substantially obviates one or more problems due to limitations and disadvantages of the related art.

An object of the present invention is to provide a method of driving a plasma display panel enabling to improve an overall contrast characteristic of the plasma display panel by reducing a voltage difference between scan and sustain electrodes Y and Z to decrease an emission amount of light generated by a discharge between the scan and sustain electrodes Y and Z.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method of driving a plasma display panel having three kinds of electrodes comprising scan, sustain and address electrodes according to the present invention includes a first step of applying a reset pulse to the scan electrode to form wall charges on the electrodes for a set-up period and a second step of applying a pulse of a predetermined level to the sustain electrode to reduce a voltage difference between the scan and sustain electrodes while the reset pulse is applied.

Preferably, the first step includes the steps of applying the reset pulse of a ramp-up waveform till a predetermined time point t of the set-up period and applying a flat-top DC voltage for stabilizing to generate the wall charges for a rest portion of the set-up period.

More preferably, a pulse having a predetermined level to reduce the voltage difference between the scan and sustain electrodes is applied to the sustain electrode while the flat-top DC voltage is applied.

More preferably, the second step includes the step of applying the pulse of the predetermined level to reduce the voltage difference between the scan and sustain electrodes to the sustain electrode at a predetermined time point after the reset pulse is applied.

More preferably, the pulse of a ramp-up waveform ascending from a base voltage is applied to the sustain electrode while the reset pulse is applied.

Preferably, the method further includes a step (A) of applying a reset pulse of a ramp-down waveform descending from a level lower than the reset pulse to a reset-down voltage to the scan electrode for a set-down period connected to the set-up period, a step (B) of applying a first DC voltage maintaining a predetermined level to the sustain electrode while the reset pulse of the ramp-down waveform is applied, and a step (c) of applying a second DC voltage maintaining a predetermined level to the sustain electrode after the step (B).

More preferably, the first DC voltage maintaining a peak voltage level of the pulse to reduce the voltage difference between the scan and sustain electrodes is applied to the sustain electrode in the step (B).

More preferably, the first DC voltage of the predetermined level different from a peak voltage level of the pulse to reduce the voltage difference between the scan and sustain electrodes is applied to the sustain electrode in the step (B).

More preferably, the second DC voltage maintaining a peak voltage level of the pulse to reduce the voltage difference between the scan and sustain electrodes is applied to the sustain electrode in the step (C).

More preferably, the second DC voltage having the predetermined level different from that of the first DC voltage is applied to the sustain electrode.

More preferably, when a drive of the plasma display panel for a single frame is divided into a plurality of sub-fields, the pulse to reduce the voltage difference between the scan and sustain electrodes is supplied for set-up periods of the entire sub-fields except a first one of a plurality of the sub-fields.

More preferably, an erase pulse to erase the wall charges remaining on the electrodes in each of the sub-fields is supplied as the pulse to reduce the voltage difference between the scan and sustain electrodes.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
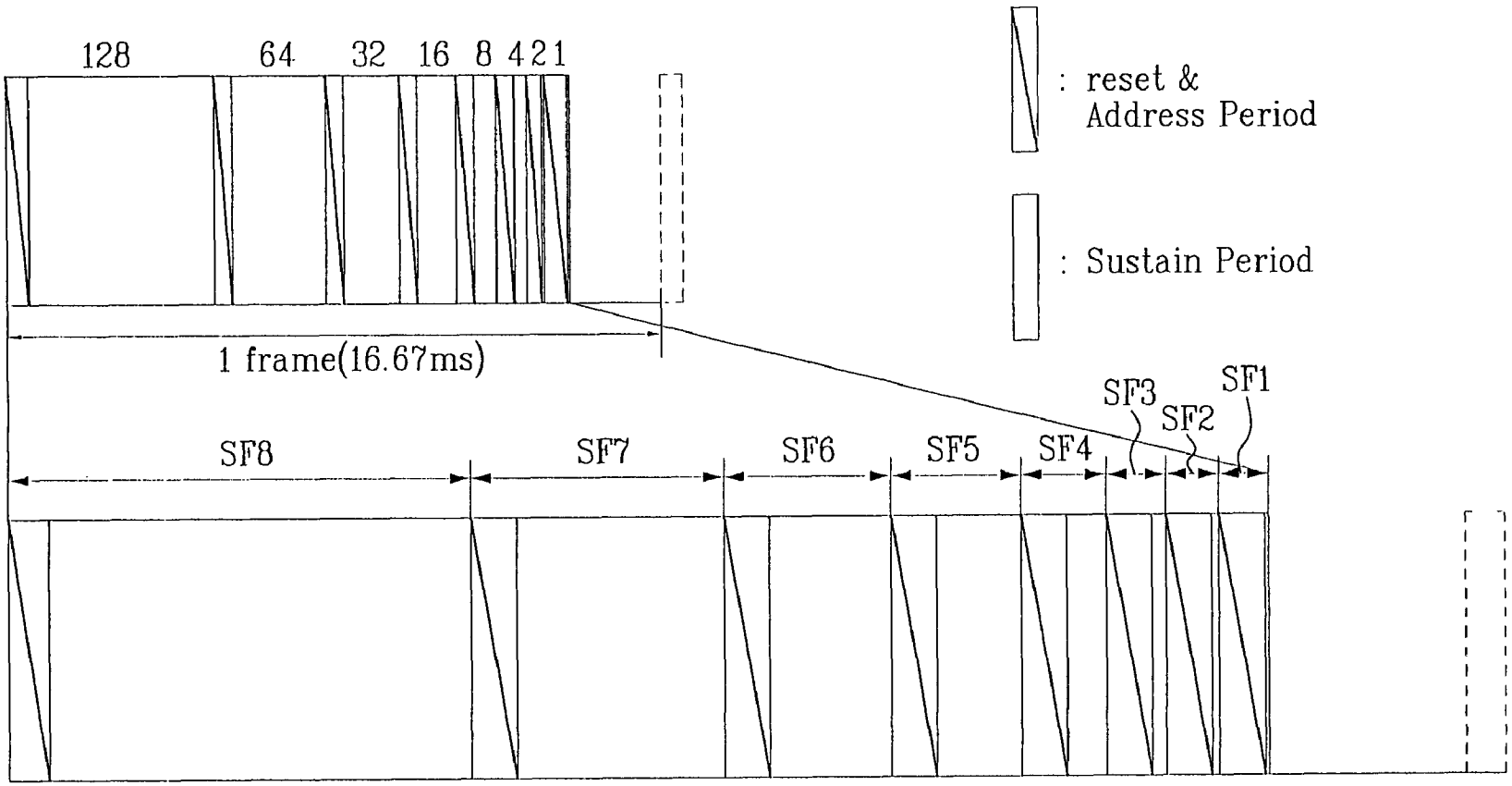
FIG.1 Related Art
FIG. 1 illustrates a constructional diagram of a frame in accordance with a PDP drive according to a related art.

Reference will now be made in detail to the preferred embodiments of the present invention, examples of which are illustrated in the accompanying drawings. Wherever possible, the same reference numbers will be used throughout the drawings to refer to the same or like parts.

In a method of driving a PDP according to the present invention explained as follows through FIGS. 4 to 20, each sub-field constructing a single frame is divided into a reset period for resetting an entire screen, an address period for selecting a cell, and a sustain period for maintaining a discharge of the selected cell. A scan electrode Y explained in the following description is occasionally known as a scan/sustain electrode and a sustain electrode Z explained in the following description is known as a common sustain electrode. Hence, there is no difference between such electrodes but expressed just by different terms.

In the following embodiments according to the present invention, a pulse for reducing a voltage difference between the scan and sustain electrodes Y and Z is applied to the sustain electrode Z during a set-up period to prevent the degradation of a contrast characteristic.

A drive mechanism by pulses applied to the respective electrodes according to the present invention is explained as follows.

First of all, a reset pulse having a ramp-up waveform ascending to a peak voltage Vr higher than a voltage level Vs of a sustain pulse Sus is applied to the scan electrode Y during the set-up period. A reset pulse having a ramp-down waveform descending to a negative reset-down voltage from a positive voltage level lower than the peak voltage Vr of the ramp-up reset pulse is then applied to the scan electrode Y during a set-down period.

While the ramp-up reset pulse is applied, a pulse for reducing a difference between the scan and sustain electrodes Y and Z is applied to the sustain electrode Z. Such a pulse is applied as various waveforms by a pulse applied to other electrodes Y and X during the set-up period or by a PDP characteristic as well as is applied thereto at various time points by them.

While the ramp-down reset pulse is applied, a positive(+) DC voltage is applied to the sustain electrode Z. A level of the DC voltage is maintained until the ramp-down reset pulse reaches the reset-down voltage.

During the subsequent address period, a DC voltage is applied to the sustain electrode Z, a negative(−) scan pulse Scan is applied sequentially to the scan electrodes Y while the DC voltage is applied, and a positive(+) data pulse Data is synchronized with the negative(−) scan pulse to apply to the address electrode X.

Finally, sustain pulses Sus are applied to the scan electrode Y during the sustain period, and specifically, another sustain pulse Sus alternating with the sustain pulses Sus applied to the scan electrode Y is applied to the sustain electrodes Z.

A drive by the pulses applied to the respective electrodes is explained as follows.

First of all, the ramp-up reset pulse applied to the scan electrode Y brings about a set-up discharge in cells of the entire screen, and the set-up discharge generates wall charges on the respective electrodes X, Y, and Z. Namely, the set-up discharge accumulates positive(+) wall charges on the address and sustain electrodes X and Z and negative(−) wall charges on the scan electrodes Y.

In this case, a discharge between the scan and sustain electrodes Y and Z is inhibited by a pulse for reducing a voltage difference between the scan and sustain electrodes Y and Z.

And, the ramp-down reset pulse applied to the scan electrode Y brings about a weak erase discharge (i.e. set-down discharge) in the cells, and the set-down discharge partially erases the wall charges formed excessively on the respective electrodes X, Y, and Z as well as unnecessary charges of space charges. Hence, after the end of the set-down period, the wall charges required for an address discharge remain in the cells of the entire screen uniformly.

When scan and data pulses are applied to the scan and address electrodes Y and X during the address period, respectively, the wall charges enough to generate the address discharge are accumulated. Specifically, the voltage difference between the scan and data pulses is added to the voltage caused by the wall charges generated for the reset period, whereby the address discharge occurs in the discharge cell supplied with the data pulse.

Wall charges enough to generate a sustain discharge are formed in the cells selected by the generated address discharge when a sustain pulse Sus is applied later.

In the discharge cell selected by the address discharge, a sustain discharge, i.e. display discharge, occurs between the scan and sustain electrodes Y and Z whenever the sustain pulse Sus is applied thereto as a voltage Vs by the sustain pulses Sus is added to a wall voltage (voltage raised by the wall charges) in the discharge cell.

After completion of the sustain discharge, an erase pulse of a ramp waveform having a small pulse width and a low voltage level is applied to the sustain electrode Z to erase the wall charges remaining in the cells of the entire screen.

The drive mechanism by the pulses applied to the respective electrodes is applicable to all the embodiments of the present invention explained as follows. Of course, there are some variations of the drive mechanism in case that a ramp-up reset pulse and a flat-top DC voltage are sequentially applied for the set-up period for the stabilization of forming the wall charges like the second, fourth, and sixth embodiments in FIG. 5, FIG. 7, and FIG. 10, respectively.

A drive mechanism, as a core of the present invention, for reducing a voltage difference between scan and sustain electrodes Y and Z is explained as follows.

First of all, the present invention is designed to prevent a surface discharge which is generated between the scan and sustain electrodes Y and Z as the voltage difference between the scan and sustain electrodes Y and Z is added to a voltage raised by wall charges generated for the reset period. In the present invention, a single pulse Zramp for reducing the voltage difference between the scan and sustain electrodes Y and Z is applied to the sustain electrode Z, and an applying time point is the set-up period in the reset period.

Specifically, the applying time point of the pulse Zramp applied to the sustain electrode Z to reduce the voltage difference between the scan and sustain electrodes Y and Z is separated into one case that the pulse Zramp is applied from a partial time point of the set-up period for the supply of a ramp-up reset pulse (first to sixth embodiments) and the other case that the pulse Zramp is synchronized with the ramp-up reset pulse to supply (seventh to fifteenth embodiments).

And, the pulse Zramp is a ramp-up waveform ascending from a base voltage to a specific voltage level or a DC waveform maintaining a predetermined voltage level.

In the present invention, the pulse Zramp applied together with the ramp-up reset pulse for the set-up period reduces the voltage difference between the scan and sustain electrodes Y and Z, thereby suppressing a discharge generated between the electrodes Y and Z. Since an amount of wall charges remaining on the sustain electrode Z is smaller than that of another electrode Y or X when an address discharge occurs, a discharge occurs weakly or fails to occur in the cells selected by the address discharge.

First of all, explained in the following are examples for one case that the pulse Zramp is applied from the partial time point of the set-up period for the supply of the ramp-up reset pulse (first to sixth embodiments).

Figure 4:
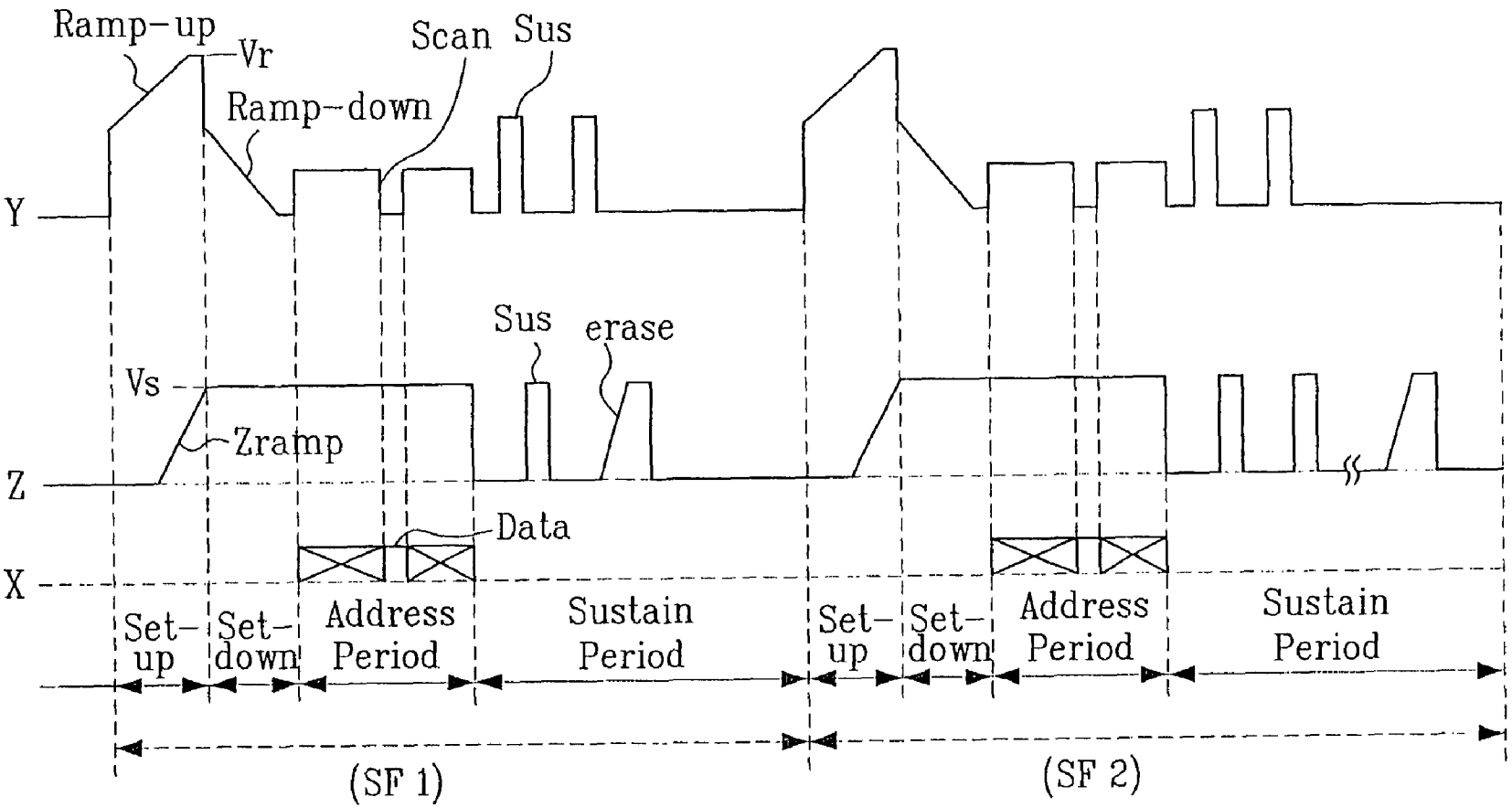
FIG. 4 illustrates a method of driving a PDP according to a first embodiment of the present invention.

FIG. 4 illustrates a method of driving a PDP according to a first embodiment of the present invention, in which a pulse Zramp of a ramp-up waveform is applied for a set-up period of each sub-field to reduce a voltage difference between scan and sustain electrodes Y and Z.

Referring to FIG. 4, a first embodiment of the present invention is explained in detail as follows.

First of all, while a ramp-up reset pulse is applied to a scan electrode Y, a ramp-up pulse Zramp is applied to a sustain electrode Z from a predetermined time point (especially, from the latter period of a set-up period). The ramp-up pulse Zramp ascends to a voltage level Vs of a sustain pulse Sus from a base voltage. Since the ramp up pulse Zramp suppresses a discharge between a scan electrode Y and the sustain electrode Z, an amount of wall charges accumulated between the scan and sustain electrodes Y and Z by a set-up discharge is smaller than that accumulated between the scan electrode Y and an address electrode X.

Subsequently, a DC voltage having a level equal to the voltage level Vs of the sustain pulse Sus is applied to the sustain electrode Z during the set down period, and the DC voltage having the same level Vs is applied thereto by an address period.

It is noticed that the present invention needs no additional drive circuit for supplying the sustain electrode Z with the ramp-up pulse Zramp. Namely, the present invention just applies an erase pulse erase applied for erasing the remaining wall charges after completion of a sustain discharge to the sustain electrode Z during the set-up period. And, a switch device for applying the erase pulse is turned on during the set-up period only.

Such a scheme that the erase pulse of the prior sub-field is applied to the sustain electrode Z during the set-up period is properly applicable to all the embodiments of the present invention.

Figure 5:
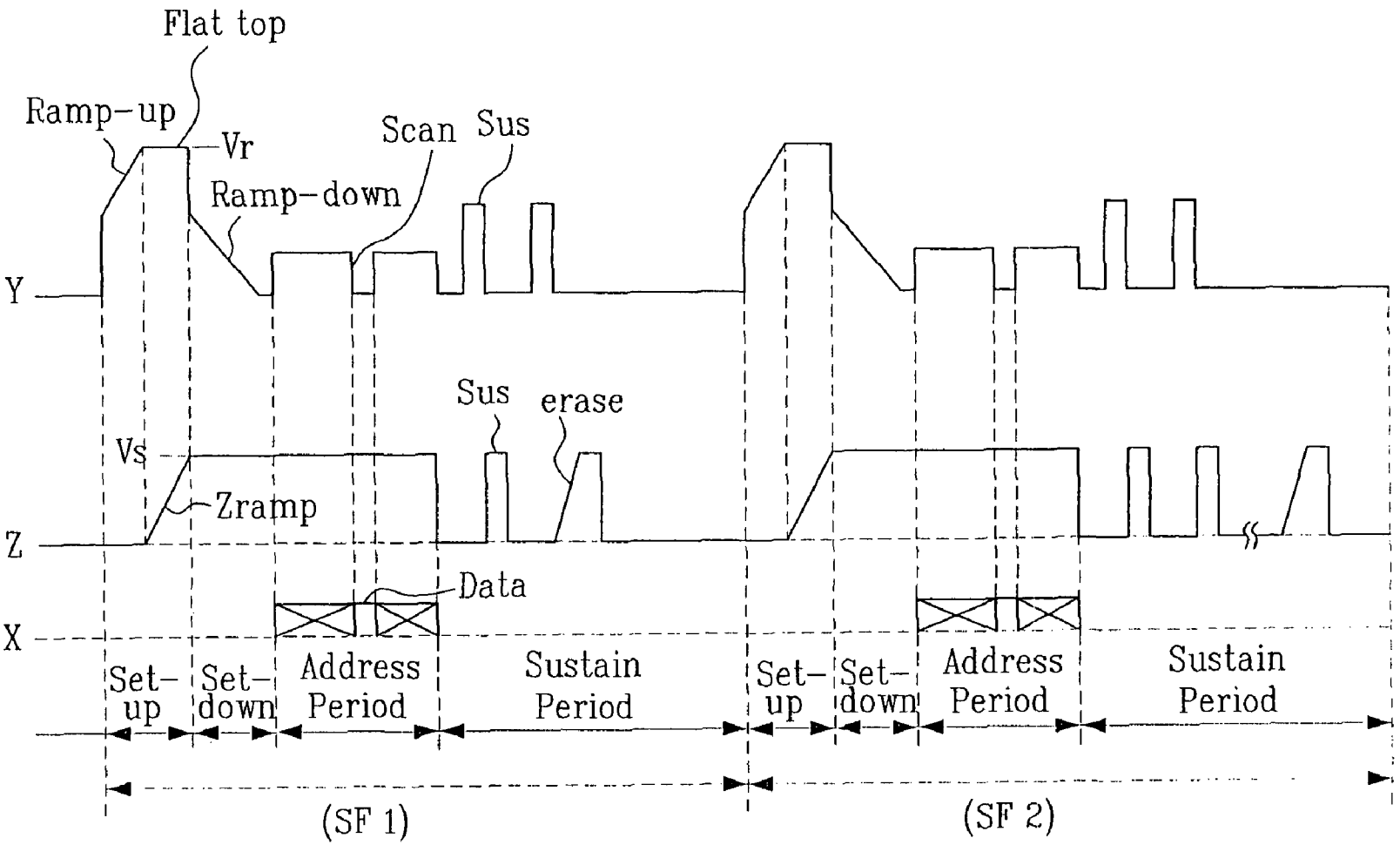
FIG. 5 illustrates a method of driving a PDP according to a second embodiment of the present invention.

FIG. 5 illustrates a method of driving a PDP according to a second embodiment of the present invention, in which a ramp-up pulse Zramp is applied for a set-up period of each sub-field to reduce a voltage difference between scan and sustain electrodes Y and Z like the first embodiment of the present invention.

Yet, a second embodiment of the present invention in FIG. 5 determines a time point of supplying a sustain electrode Z with the ramp-up pulse Zramp in a following manner.

First of all, in order to stabilize the formation of wall charges in each sub-field, the present invention sequentially supplies a ramp-up reset pulse and a flat-top DC voltage for a set-up period. In the early stage of the set-up period, the ramp-up pulse has a waveform ascending to a peak voltage Vr higher than a voltage level of a sustain pulse Sus. And, the flat-top DC voltage maintaining the peak voltage Vr is applied for the latter period of the set-up period. Hence, before the flat-top DC voltage is applied to a scan electrode Y, the necessary discharges between the scan and address electrodes Y and X and between the scan and sustain electrodes Y and Z are entirely ended.

The pulse Zramp of the ramp-up waveform to reduce the voltage difference between the scan and sustain electrodes Y and Z in each of the sub-fields is applied to the sustain electrode Z while the flat-top DC voltage is applied. Namely, the ramp-up pulse Zramp ascends to the voltage level Vs of the sustain pulse Sus from the base voltage while the flat-top DC voltage is applied.

Like the second embodiment of the present invention in FIG. 5, as the pulse Zramp having the ramp-up waveform is applied to the sustain electrode Z, the unnecessary discharge between the scan and sustain electrodes Y and Z is suppressed while the flat-top DC voltage is applied.

Figure 6:
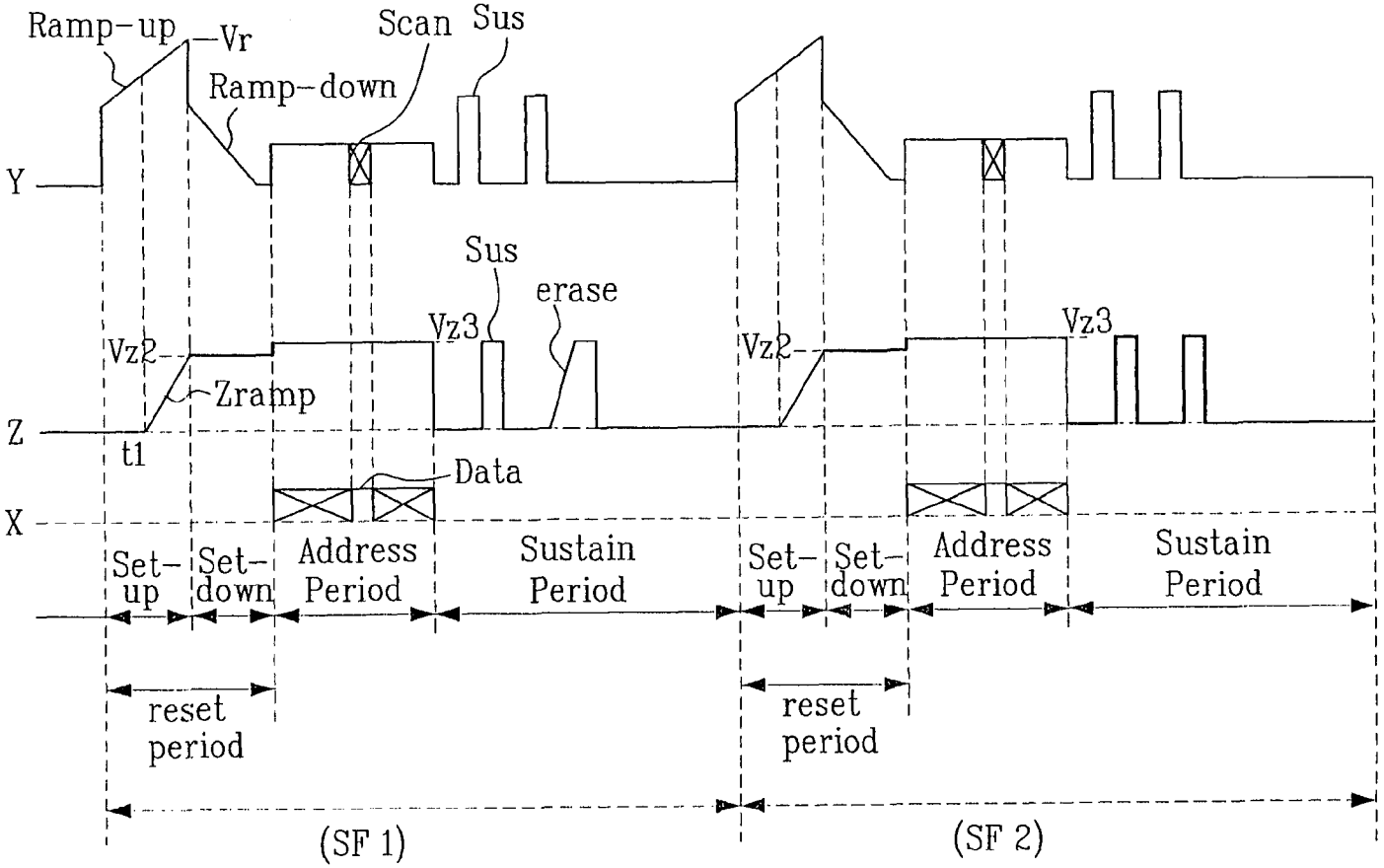
FIG. 6 illustrates a method of driving a PDP according to a third embodiment of the present invention.

FIG. 6 illustrates a method of driving a PDP according to a third embodiment of the present invention, in which a ramp-up pulse Zramp is applied from a partial time point of a set-up period to reduce a voltage difference between scan and sustain electrodes Y and Z like the first embodiment of the present invention.

Yet, in a third embodiment of the present invention in FIG. 6, a ramp-up pulse Zramp applied to a sustain electrode Z has a waveform ascending to a level lower than a voltage level Vs of a sustain pulse Sus. And, a DC voltage applied for a set-down period maintains a level lower than the voltage level Vs of the sustain pulse Sus. This is for a more stable address discharge.

Referring to FIG. 6, as a ramp-up reset pulse is applied to a scan electrode Y, a discharge between a scan electrode Y and the sustain electrode Z and a discharge between the scan and sustain electrodes Y and Z are generated, respectively. Hence, positive(+) wall charges are accumulated on the address and sustain electrodes X and Z respectively, while negative(−) wall charges are accumulated on the scan electrode Y. In this case, since the discharge between the scan and sustain electrodes Y and Z has influence on another discharge to degrade a contrast characteristic, the discharge between the scan and sustain electrodes Y and Z should be small and occur shortly.

For this, while the ramp-up pulse is applied to the scan electrode Y in each sub-field, the ramp-up pulse Zramp is applied to the sustain electrode Z from a predetermined time point t1. The ramp-up pulse Zramp ascends to a level lower than the voltage level Vs of the sustain pulse Sus from a base voltage. Since the ramp-up pulse Zramp suppresses the discharge between the san and sustain electrodes Y and Z, an amount of the wall charges accumulated between the scan and sustain electrodes Y and Z by a set-up discharge is smaller than that accumulated between the scan and address electrodes Y and X.

Subsequently, a DC voltage having a voltage level Vz2 lower than the voltage level Vs of the sustain pulse Sus is applied to the sustain electrode Z during a set-down period of each of the sub-fields. Since an amount of the wall charges reduced by the ramp-down reset pulse applied to the scan electrode Y for the set-down period depends on the DC voltage applied to the sustain electrode Z, the DC voltage of the voltage level Vz2 lower than the voltage level Vs of the sustain pulse Sus is applied to the sustain electrode Z in order to reduce the amount of the wall charges reduced by the ramp-down reset pulse. Thus, by decreasing the amount of the wall charges reduced by the ramp-down reset pulse, an address discharge during an address period can be generated more stably.

Yet, for a subsequent address period, a DC voltage having a voltage level Vz3(=Vs) equal to the voltage level Vs of the sustain pulse Sus is applied to the sustain electrode Z. The reason why the DC voltage shifted to the voltage level Vs of the sustain pulse Sus for the address period is applied to the sustain electrode Z is to prevent the possibility that the address discharge generated between the scan and address electrodes Y and X may lead to the surface discharge between the scan and sustain electrodes Y and Z by increasing the voltage difference from a low voltage of a scan pulse Scan applied to the scan electrode Y.

Figure 7:
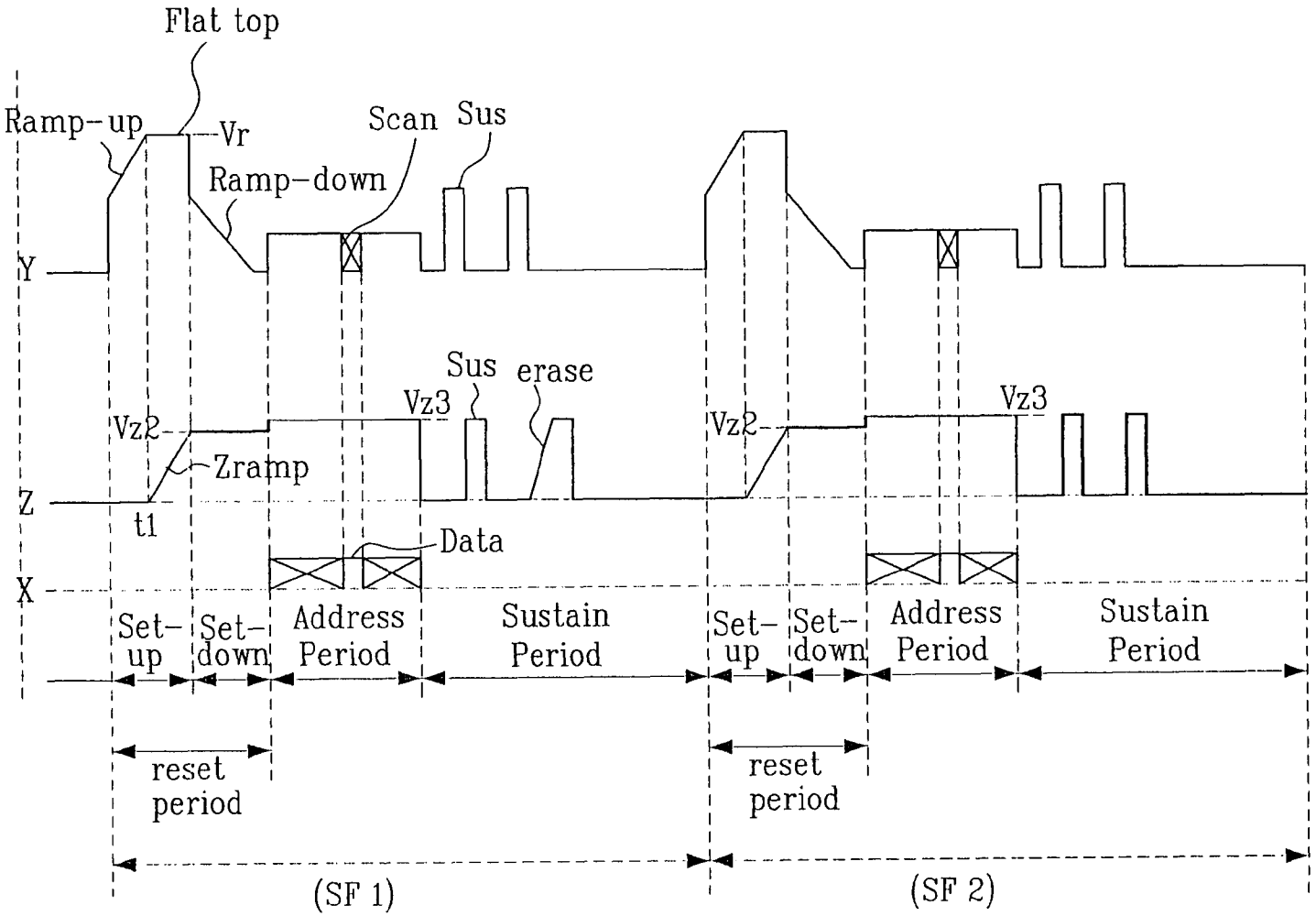
FIG. 7 illustrates a method of driving a PDP according to a fourth embodiment of the present invention.

FIG. 7 illustrates a method of driving a PDP according to a fourth embodiment of the present invention, in which a ramp-up pulse Zramp is applied from a partial time point of a set-up period to reduce a voltage difference between scan and sustain electrodes Y and Z like the first embodiment of the present invention.

Yet, in a fourth embodiment of the present invention in FIG. 7, a ramp-up pulse Zramp applied to a sustain electrode Z has a waveform ascending to a level Vz2 lower than a voltage level Vs of a sustain pulse Sus. And, for a more stable address discharge, a DC voltage applied for a set-down period maintains the level Vz2 lower than the voltage level Vs of the sustain pulse Sus, which is the same of the third embodiment of the present invention.

And, the fourth embodiment according to the present invention in FIG. 7 determines a time point of supplying a sustain electrode Z with the ramp-up pulse Zramp in a following manner.

First of all, in order to stabilize the formation of wall charges in each sub-field, the present invention sequentially supplies a ramp-up reset pulse and a flat-top DC voltage for a set-up period. In the early stage of the set-up period, the ramp-up pulse has a waveform ascending to a peak voltage Vr higher than the voltage level of the sustain pulse Sus. And, the flat-top DC voltage maintaining the peak voltage Vr is applied for the latter period of the set-up period.

The pulse Zramp of the ramp-up waveform to reduce the voltage difference between the scan and sustain electrodes Y and Z in each of the sub-fields is applied to the sustain electrode Z from a time point t1 of applying the flat-top DC voltage. Namely, the ramp-up pulse Zramp ascends to a level Vz2 lower than the voltage level Vs of the sustain pulse Sus from a base voltage while the flat-top DC voltage is applied. Hence, the unnecessary discharge, which may be generated between the scan and sustain electrodes Y and Z while the flat-top DC voltage is applied, is suppressed.

In the fourth embodiment according to the present invention in FIG. 7, the DC voltage maintaining the level Vz2 lower than the voltage level Vs of the sustain pulse Sus is also applied to the sustain electrode Z for the set-down period. The DC voltage applied to the sustain electrode Z for the set-down period reduces the amount of the wall charges decreased by the ramp-down reset pulse. Thus, by decreasing the amount of the wall charges reduced by the ramp-down reset pulse, an address discharge during the address period occurs more stably.

For the latter period of the address period, the DC voltage having the same voltage level Vz3(=Vs) of the voltage level Vs of the sustain pulse Sus is applied to the sustain electrode Z.

Figure 8:
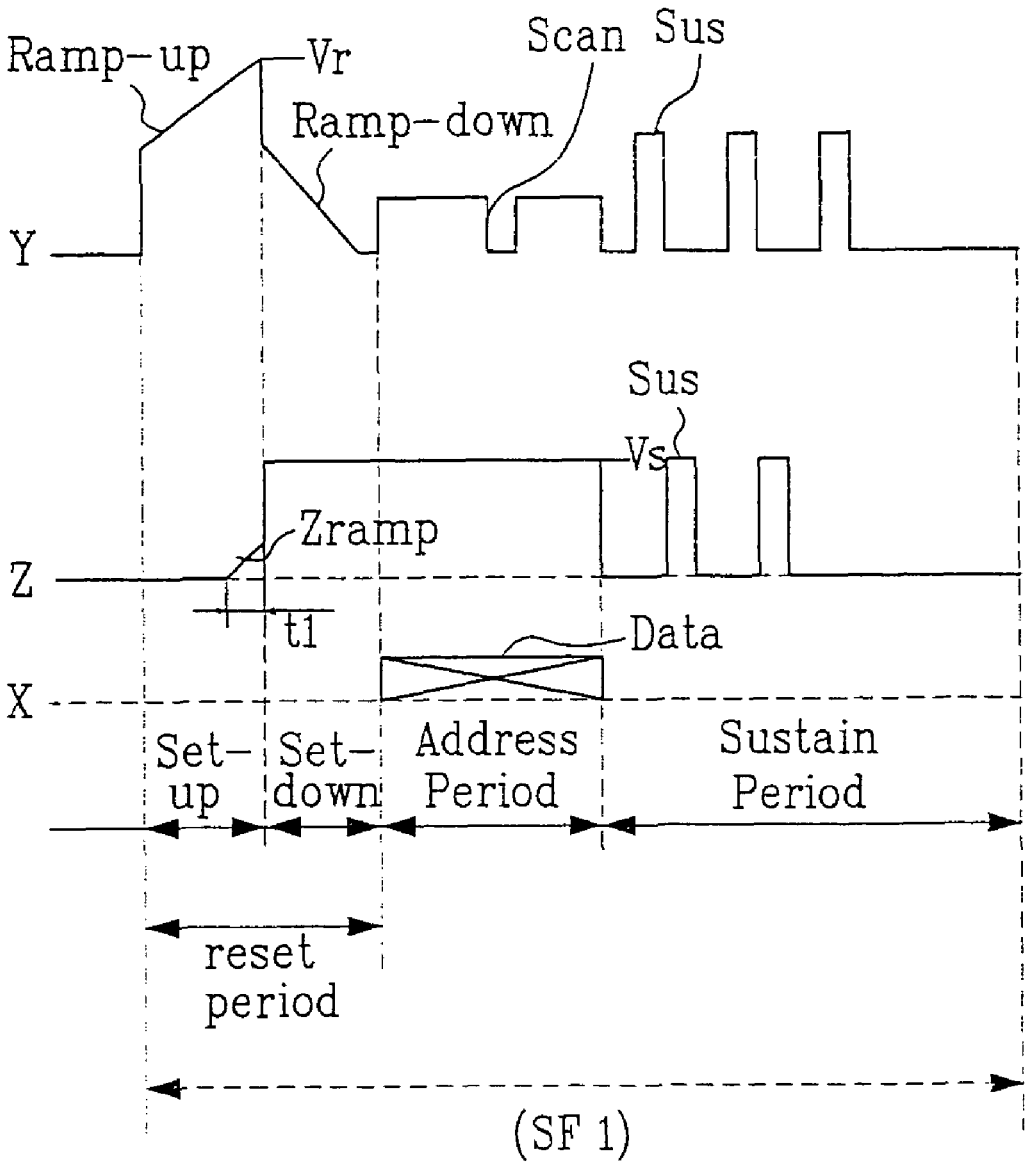
FIG. 8 illustrates a method of driving a PDP according to a fifth embodiment of the present invention.

FIG. 8 illustrates a method of driving a PDP according to a fifth embodiment of the present invention, in which a ramp-up pulse Zramp is applied from a partial time point of a set-up period to reduce a voltage difference between scan and sustain electrodes Y and Z like the first embodiment of the present invention.

Yet, in a fifth embodiment of the present invention in FIG. 8, a ramp-up pulse Zramp applied to a sustain electrode Z has a waveform ascending to a level lower than a voltage level Vs of a sustain pulse Sus. And, a DC voltage applied for a set-down period maintains the level of the voltage Vs of the sustain pulse Sus.

Referring to FIG. 8, as a ramp-up reset pulse is applied to a scan electrode Y, a discharge between a scan electrode Y and the sustain electrode Z and a discharge between the scan and sustain electrodes Y and Z are generated, respectively. In this case, in order to for the discharge between the scan and sustain electrodes Y and Z to occur small and shortly, the ramp up pulse Zramp is applied to the sustain electrode Z from a predetermined time point t1 while the reset pulse is applied to the scan electrode Y in each of the sub-fields. The ramp-up pulse Zramp has a waveform which maintains the level of the base voltage in the early stage of the set-up period and then ascends to a level lower than the voltage level Vs of the sustain pulse Sus from a predetermined time point t1.

Hence, before the time point of applying the ramp-up pulse Zramp of the set-up period, the set-up discharge occurs in the cells of the entire screen by the ramp-up reset pulse applied to the scan electrode Y. And, the discharge between the scan and sustain electrodes Y and Z is suppressed from the time point t1 of applying the ramp-up pulse Zramp.

In order to supply the ramp-up pulse, the sustain electrode Z maintains a floating state from a predetermined time point t1 of the set-up period until the ramp-up reset pulse reaches a peak voltage Vr. As the sustain electrode Z maintains the floating state, the ramp-up pulse Zramp is induced to the sustain electrode Z.

Figure 9:
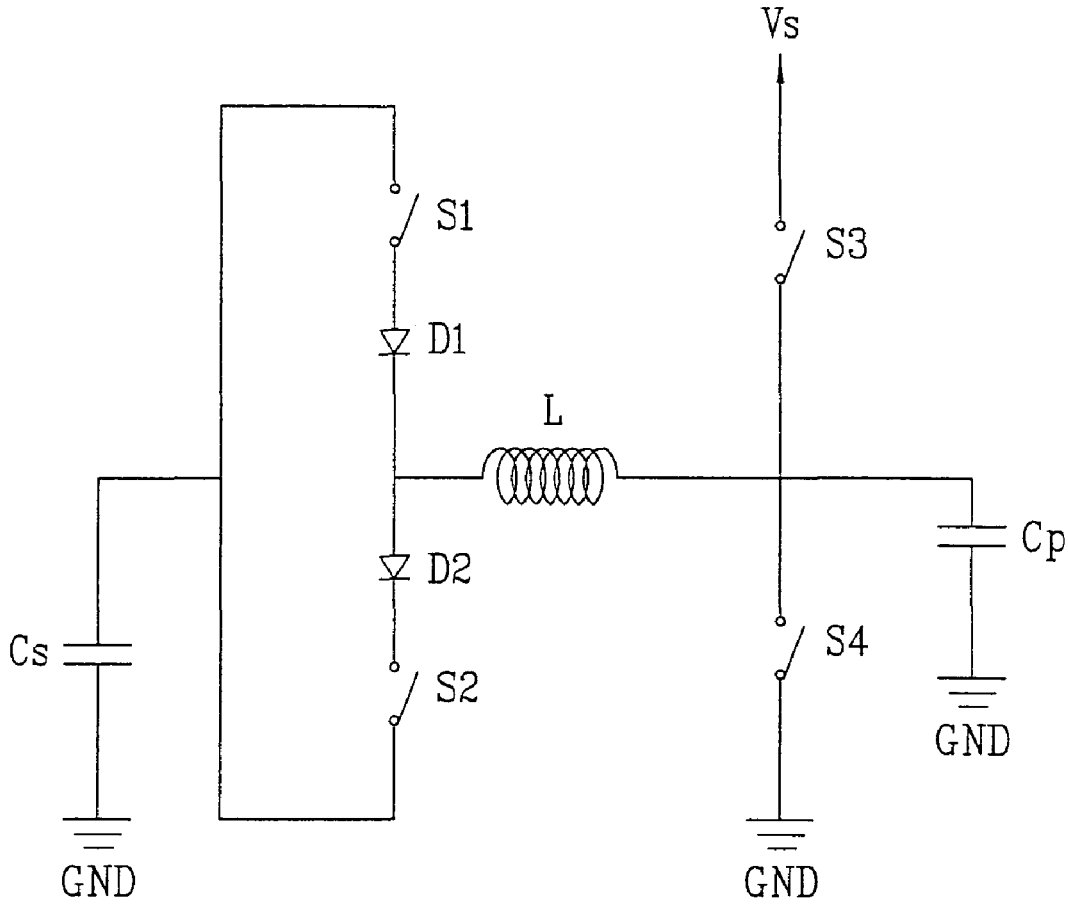
FIG. 9 illustrates a diagram of an energy recovery circuit for floating in a PDP drive of the present invention.

In this case, the sustain electrode Z is floated by an energy recovery circuit shown in FIG. 9.

FIG. 9 illustrates a diagram of an energy recovery circuit for floating in a PDP drive of the present invention.

Referring to FIG. 9, an energy recovery circuit installed at a sustain electrode Z includes a source capacitor Cs, first to fourth switches S1 to S4, first and second diodes D1 and D2, an inductor L, and a panel capacitor Cp.

The capacitor Cs is charged by a voltage charged in the panel capacitor Cp as well as supplies the panel capacitor Cp with its charges voltage.

The first and second diodes D1 and D2 control a flow of a current.

And, the first to fourth switches S1 to S4 are turned on/off by control signals of a controller (not shown in the drawing.

Specifically, the fourth switch S4 is turned on to apply a base voltage GND to the sustain electrode Z till a predetermined time t1 of a set-up period for supplying a ramp-up reset pulse only.

From the predetermined time point t1 which a ramp-up pulse Zramp is applied, the fourth switch S4 is turned off and the first to third switches S1 to S3 maintain their turned-off states as they are. Hence, the sustain electrode Z maintains a floating state.

The third switch S3 is turned off during the set-down period to supply the sustain electrode Z with a DC voltage having a voltage level Vs of a sustain pulse Sus.

And, the third switch S3 is turned off till an address period to have the sustain electrode Z maintain the same DC voltage of the voltage level Vs of the sustain pulse Sus. Hence, for a set-down period of each sub-field, the DC voltage having the voltage level equal to the voltage level Vs of the sustain pulse Sus is applied to the sustain electrode Z.

Figure 10:
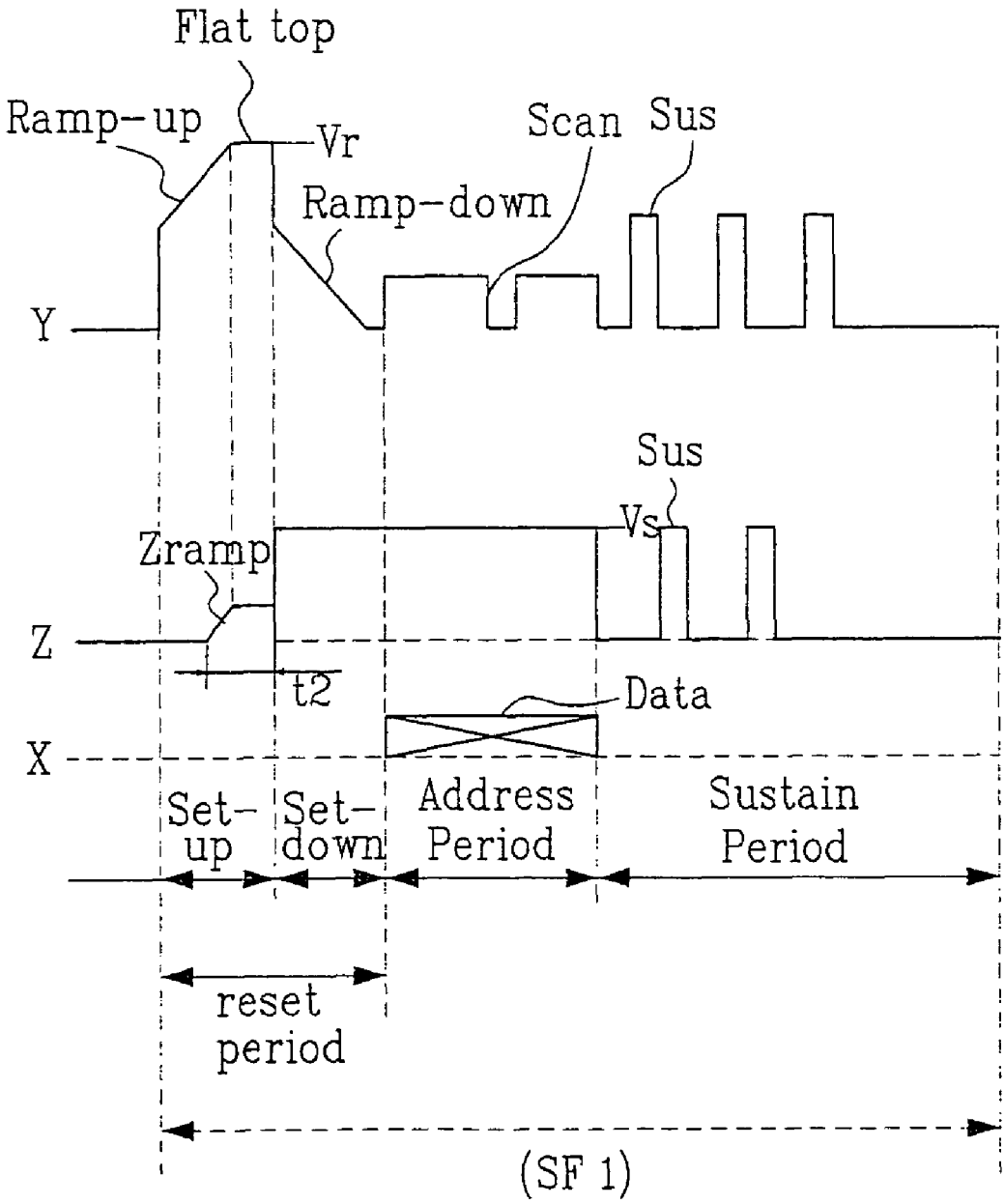
FIG. 10 illustrates a method of driving a PDP according to a sixth embodiment of the present invention.

FIG. 10 illustrates a method of driving a PDP according to a sixth embodiment of the present invention, in which a pulse Zramp is applied from a partial time point of a set-up period to reduce a voltage difference between scan and sustain electrodes Y and Z like the first embodiment of the present invention.

In the sixth embodiment of the present invention in FIG. 10, a pulse Zramp applied to a sustain electrode Z has a waveform which ascends to a level lower than a voltage level Vs of a sustain pulse Sus and then maintains the peak voltage for a predetermined time. And, a DC voltage applied for a set-down period maintains the level equal to the voltage level Vs of the sustain pulse Sus.

And, the sixth embodiment according to the present invention in FIG. 10 determines a time point of supplying a sustain electrode Z with the pulse Zramp in a following manner.

First of all, in order to stabilize the formation of wall charges in each sub-field, a ramp-up reset pulse and a flat-top DC voltage are sequentially applied for a set-up period. In the early stage of the set-up period, the ramp-up pulse has a waveform ascending to a peak voltage Vr higher than the voltage level of the sustain pulse Sus. And, the flat-top DC voltage maintaining the peak voltage Vr is applied to a scan electrode Y for the latter period of the set-up period.

The pulse Zramp to reduce a voltage difference between the scan and sustain electrodes Y and Z in each of the sub-fields is applied from a time point t2 during the period of applying the ramp-up reset pulse. Specifically, in order to apply the pulse Zramp to reduce the voltage difference, the sustain electrode Z maintains a floating state from the predetermined time t2 of the set-up period to an end time point of the set-up period.

In the sixth embodiment according to the present invention in FIG. 10, the pulse Zramp for reducing the voltage difference between the scan and sustain electrodes Y and Z, as mentioned in the foregoing description, has a ramp-up wave form and a DC waveform. Namely, the pulse Zramp of the ramp-up waveform, which ascends from the base voltage to the peak voltage Vr for a period between the predetermined time point t2 for applying the ramp-up reset pulse and the time point of starting applying the flat-top DC voltage, is applied to the sustain electrode Z, and the peak voltage is maintained from the time point of starting applying the flat-top DC voltage to the end of the set-up period. In other words, the sustain electrode Z maintains the base voltage from the time point of starting applying the ramp-up reset pulse for a predetermined time. Thereafter, the pulse Zramp of the ramp-up waveform is applied to the sustain electrode Z from the predetermined time t2 of starting applying the ramp-up reset pulse. And, the peak voltage of the pulse Zramp is continuously maintained on the sustain electrode Z once the flat-top DC voltage is applied to the scan electrode Y.

Thus, the pulse Zramp applied to the sustain electrode Z for the set-up period suppresses an unnecessary discharge which may occur between the scan and sustain electrodes Y and Z while the flat-top DC voltage is applied to the scan electrode Y.

The drive during a set-down period and the subsequent period is equivalent to that of the fifth embodiment of the present invention 1 FIG. 8, which is skipped.

Meanwhile, explained in the following are examples (seventh to fifteenth embodiments according to the present invention) for the other case that a pulse Zramp for reducing a voltage difference between scan and sustain electrodes Y and Z is synchronized with a ramp-up reset pulse applied to the scan electrode Y for a set-up period.

Figure 11:
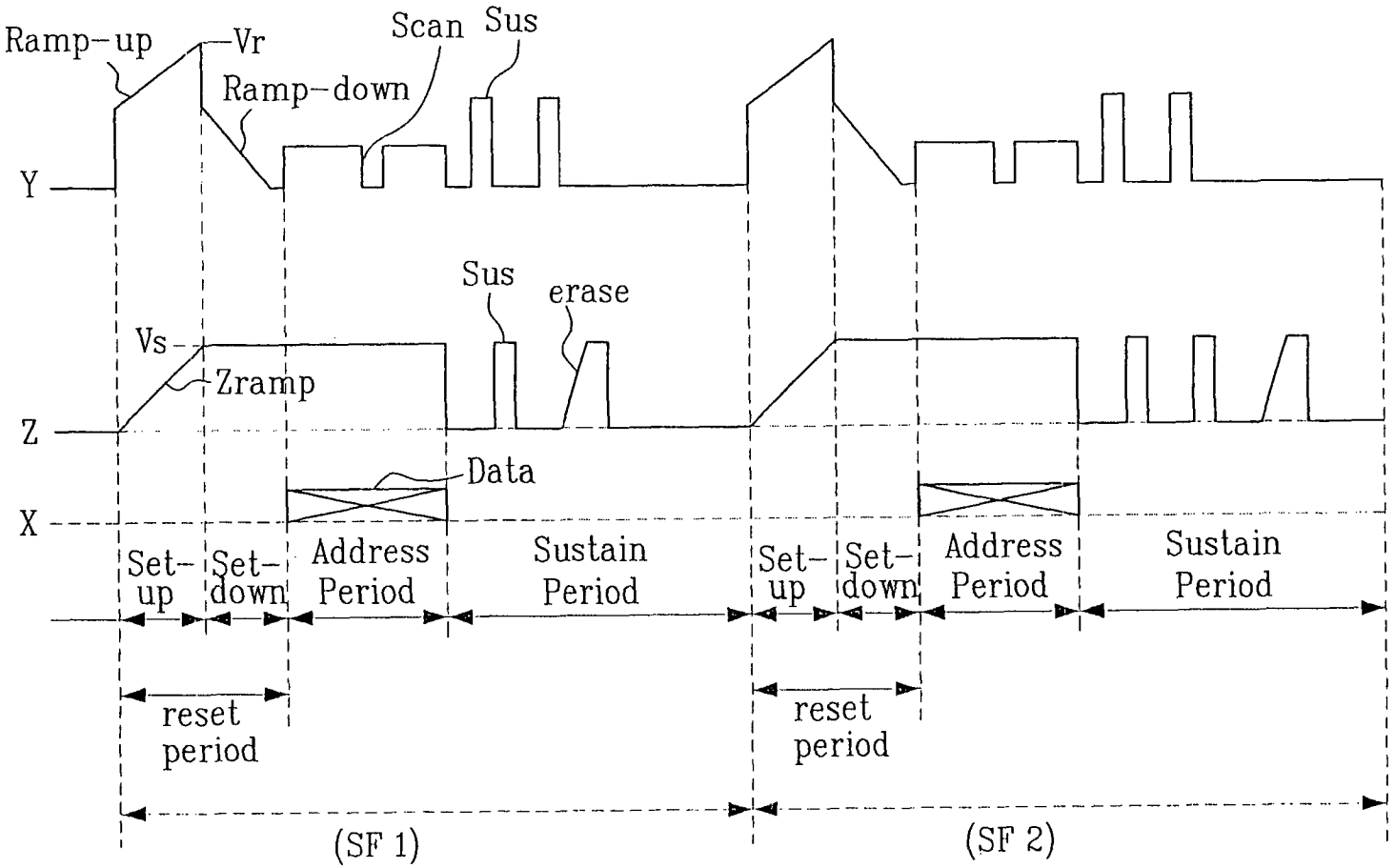
FIG. 11 illustrates a method of driving a PDP according to a seventh embodiment of the present invention.

FIG. 11 illustrates a method of driving a PDP according to a seventh embodiment of the present invention, in which a pulse Zramp of a ramp-up waveform synchronized with a ramp-up reset pulse for a set-up period of each sub-field is applied to a sustain electrode Z to reduce a voltage difference between the scan and sustain electrodes Y and Z.

Referring to FIG. 11, for a set-up period, a ramp-up reset pulse is applied to a scan electrode Y and a ramp-up pulse Zramp synchronized with the ramp-up reset pulse is applied to a sustain electrode Z. A ramp-down pulse is applied to the scan electrode Y for a set-down period, and a positive(+) DC voltage Vs is applied to the sustain electrode Z while a ramp-down reset pulse is applied to the scan electrodes Y. Namely, the positive(+) DC voltage Vs starts being applied to the sustain electrodes Z at a time point of applying the ramp-down reset pulse to the scan electrode Y, and the voltage level Vs is maintained until the ramp-down reset pulse reaches a negative(−) reset-down voltage. A level of the positive(+) DC voltage applied to the sustain electrode Z is equal to a voltage level Vs of a sustain pulse Sus.

The ramp-up reset pulse applied to the entire scan electrodes Y for the set-up period ascends to a peak voltage Vr higher than the voltage level Vs of the ramp-up pulse Zramp applied to the sustain electrode Z for the set-up period. Compared to the ramp-up reset pulse, the other ramp-up pulse Zramp applied to the sustain electrode Z has a slope smaller than that of the ramp-up reset pulse as well as has a level lower than the peak voltage level (Vr>Vs).

Thus, the ramp-up reset pulse applied to the scan electrode Y brings up a set-up discharge in discharge cells of the entire screen. In this case, the ramp-up pulse Zramp applied to the sustain electrode Z lowers the voltage difference between the scan and sustain electrodes Y and Z. Hence, an amount of the accumulated wall charges formed between the sustain and scan electrodes Z and Y becomes smaller than that between the scan and address electrodes Y and X, thereby suppressing a surface discharge that may occur between the sustain and scan electrodes Z and Y.

And, the DC voltage applied to the sustain electrode Z from the set-down period continuously maintains its voltage level Vs for an address period as well.

The above-explained scheme is applicable to drive the subsequent sub-fields.

Figure 12:
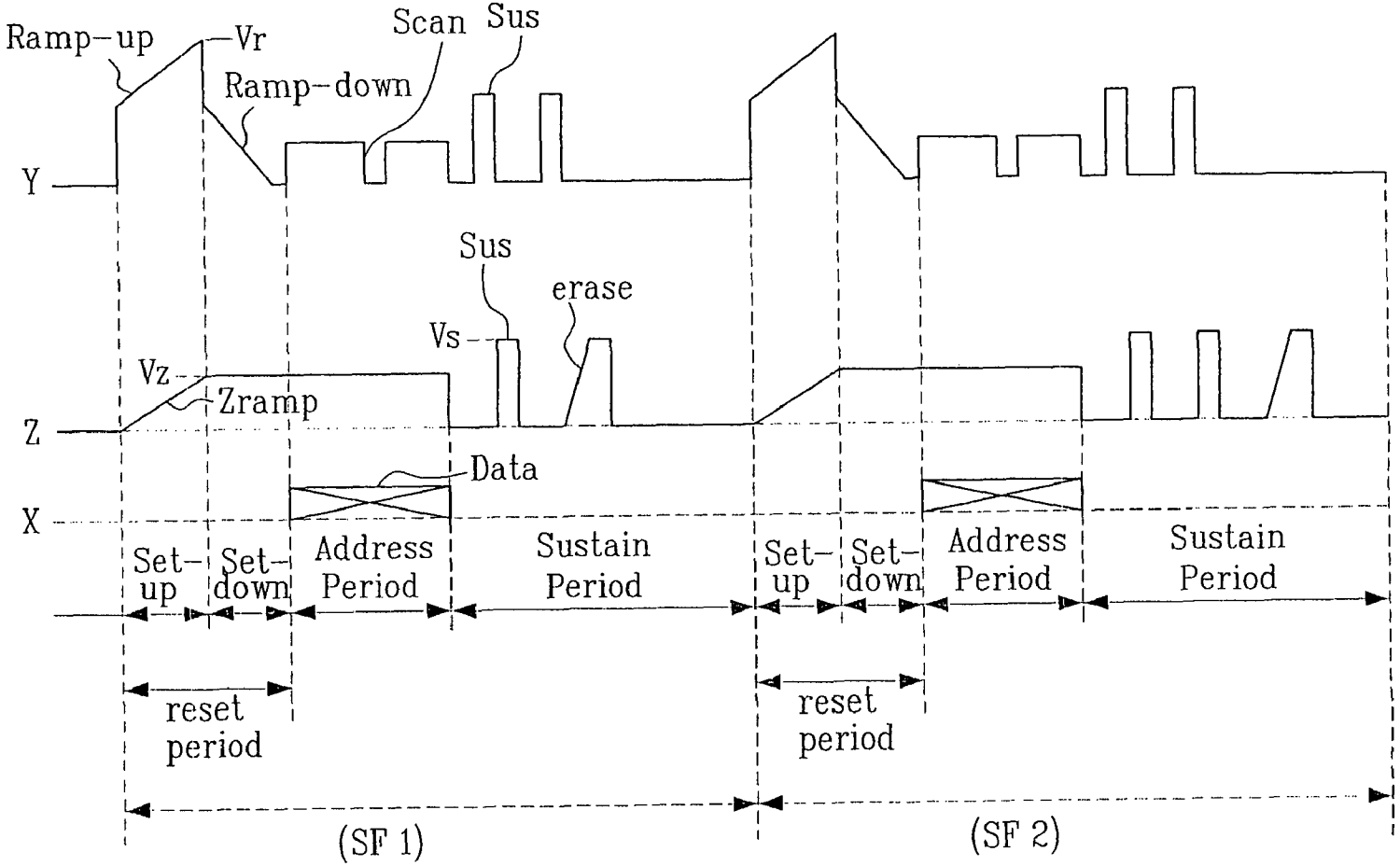
FIG. 12 illustrates a method of driving a PDP according to an eighth embodiment of the present invention.

FIG. 12 illustrates a method of driving a PDP according to an eighth embodiment of the present invention, in which a pulse Zramp of a ramp-up waveform synchronized with a ramp-up reset pulse for a set-up period of each sub-field is applied to a sustain electrode Z to reduce a voltage difference between the scan and sustain electrodes Y and Z. The eighth embodiment of the present invention differs from the seventh embodiment of the present invention in that a peak voltage level Vz of the ramp-up pulse Zramp for reducing the voltage difference is smaller than a voltage level Vs of a sustain pulse Sus.

Referring to FIG. 12, for a set-up period, a ramp-up reset pulse is applied to a scan electrode Y and a ramp-up pulse Zramp synchronized with the ramp-up reset pulse is applied to a sustain electrode Z. The ramp-up pulse Zramp applied to a sustain electrode has a waveform ascending to a peak voltage Vz lower than a voltage Vs of a sustain pulse Sus applied for a sustain period.

A ramp-down reset pulse is applied to the scan electrode Y for a set-down period, and a positive(+) DC voltage is applied to the sustain electrode Z while the ramp-down reset pulse is applied to the scan electrodes Y. Namely, the positive(+) DC voltage starts being applied to the sustain electrodes Z from a time point that the ramp-down reset pulse is applied to the scan electrode Y and continues being applied thereto until reaching a negative(−) reset-down voltage. The positive(+) DC voltage has a voltage level Vz lower than the voltage Vs of the sustain pulse Sus.

The ramp-up reset pulse applied to the entire scan electrodes Y for the set-up period ascends to a peak voltage Vr higher than the voltage level Vs of the sustain pulse Sus applied for a sustain period as well as higher than the voltage level Vz of the ramp-up pulse Zramp applied to the sustain electrode Z for the set-up period. Compared to the ramp-up reset pulse, the ramp-up pulse Zramp applied to the sustain electrode Z has a slope smaller than that of the ramp-up reset pulse and has a peak voltage level lower than that of the ramp-up reset pulse (Vr>Vs>Vz).

Hence, a set-up discharge is generated in discharge cells of the entire screen by the ramp-up reset pulse applied to the scan electrode Y. In this case, the ramp-up pulse Zramp applied to the sustain electrode Z reduces a voltage difference between the scan and sustain electrodes Y and Z. Since an accumulated amount of wall charges formed between the sustain and scan electrodes Z and Y is relatively smaller than that between the scan and address electrodes Y and X, a surface discharge that may occur between the sustain and scan electrodes Z and Y can be suppressed.

And, the DC voltage applied to the sustain electrode Z from the set-down period continuously maintains its voltage level Vz for an address period.

The DC voltage applied to the sustain electrode Z from the set-down period is continuously applied to the sustain electrodes Z for the address period, and a negative(−) scan pulse Scan is sequentially applied to the scan electrodes Y while the DC voltage Vz is applied to the sustain electrodes Z. Moreover, a positive(+) data pulse Data synchronized with the negative(−) scan pulse Scan is applied to the address electrodes X. Once the scan and data pulses Scan and Data are applied thereto, wall charges are accumulated enough to bring about an address discharge. Specifically, a voltage difference between the scan and data pulses Scan and Data is added to a voltage raised by the wall charges generated for the reset period, whereby the address discharge occurs in the discharge cell supplied with the data pulse Data. In this case, since a remaining amount of the accumulated wall charges between the sustain and scan electrodes Z and Y, as mentioned in the foregoing description, is small, there occurs no discharge or a weak discharge.

The above-described drive scheme is applied to each of the subsequent sub-fields.

Figure 13:
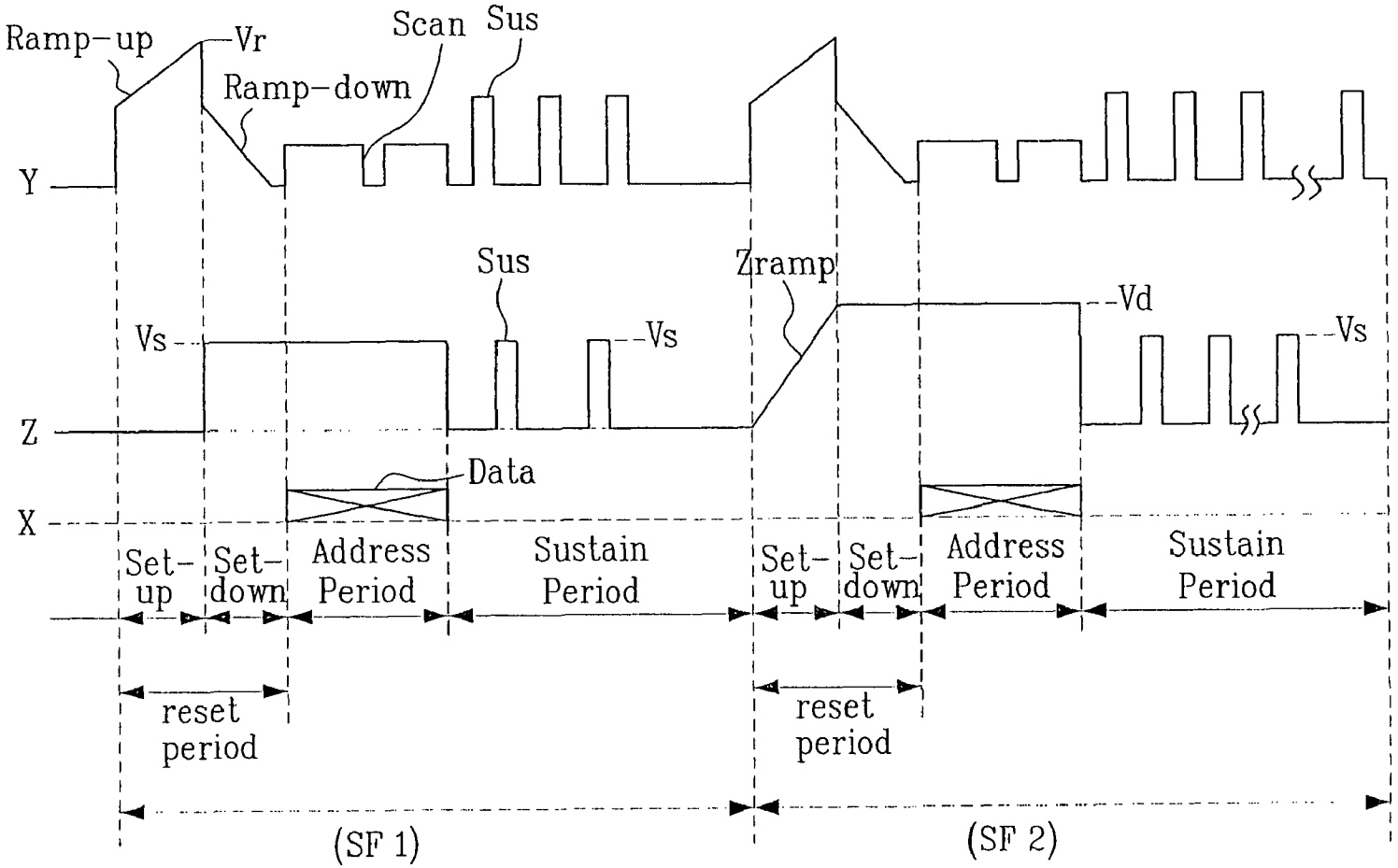
FIG. 13 illustrates a method of driving a PDP according to a ninth embodiment of the present invention.

FIG. 13 illustrates a method of driving a PDP according to a ninth embodiment of the present invention, in which a pulse Zramp of a ramp-up waveform synchronized with a ramp-up reset pulse for set-up periods of the entire sub-fields except the first sub-field SF1 is applied to a sustain electrode Z to reduce a voltage difference between the scan and sustain electrodes Y and Z. The ninth embodiment of the present invention differs from the seventh or eighth embodiment of the present invention in that a peak voltage level Vd of the ramp-up pulse Zramp for reducing the voltage difference is greater than a voltage level Vs of a sustain pulse Sus, the ramp-up pulse Zramp is not applied to the first sub-field SF1, and an erase pulse for erasing wall charges remaining in cells of the entire screen is not supplied.

Figure 2:
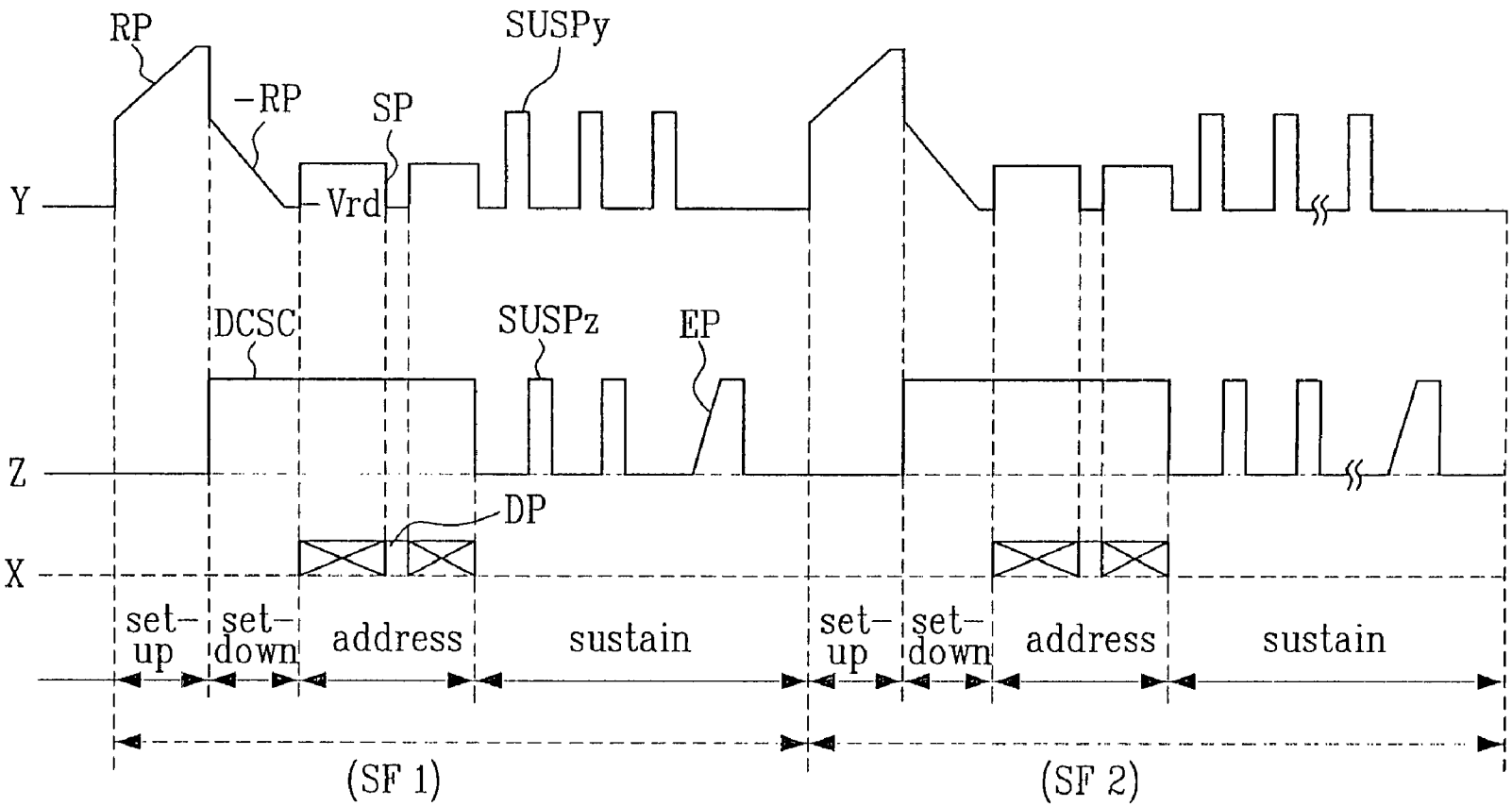
FIG.2 Related Art
FIG. 2 illustrates a diagram of a drive waveform according to a PDP drive in the frame in FIG. 1.
Figure 3A:
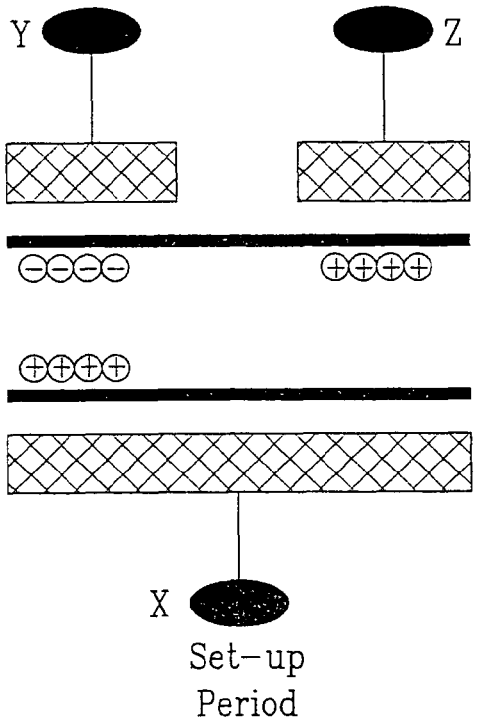
FIG. 3A Related Art
FIG. 3 illustrates a diagram of wall charge formation of set-up and set-down periods according to a square waveform in FIG. 2.
Figure 3B:
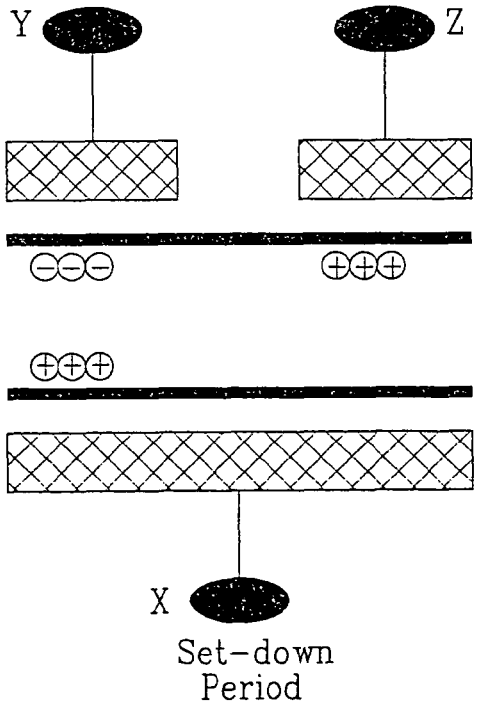
FIG. 3B Related Art

Referring to FIG. 13, the PDP driving method according to the ninth embodiment of the present invention follows the same scheme explained through FIG. 2 except that an erase pulse is not applied to a sustain electrode Z in a first sub-field SF1. Hence, a drive scheme for the first sub-field SF1 is skipped in this description.

When the first sub-field SF1 is terminated, a state that the wall charges formed in the discharge cells are not removed continues to a second sub-field SF2.

A drive scheme of a second sub-field SF2 according to the ninth embodiment of the present invention is explained as follows.

First of all, for a set-up period of the second sub-field SF2, a ramp-up reset pulse is applied to a scan electrode Y and a ramp-up pulse Zramp synchronized with the ramp-up reset pulse is applied to a sustain electrode Z. The ramp-up pulse Zramp applied to the sustain electrode Z has a waveform ascending from a base voltage to a peak voltage Vd higher than a voltage Vs of a sustain pulse Sus applied for a sustain period.

A ramp-down reset pulse is applied to the scan electrode Y for a set-down period, and a positive(+) DC voltage is applied to the sustain electrode Z while the ramp-down reset pulse is applied to the scan electrodes Y. Namely, the positive(+) DC voltage starts being applied to the sustain electrodes Z from a time point that the ramp-down reset pulse is applied to the scan electrode Y and continues being applied thereto until reaching a negative(−) reset-down voltage. The positive(+) DC voltage has a voltage level Vd higher than the voltage Vs of the sustain pulse Sus.

The ramp-up reset pulse applied to the entire scan electrodes Y for the set-up period ascends to a peak voltage Vr higher than the voltage level Vs of the sustain pulse Sus applied for a sustain period. Compared to the ramp-up reset pulse, the ramp-up pulse Zramp applied to the sustain electrode Z has a slope greater than that of the ramp-up reset pulse and has a peak voltage Vd higher than the voltage level Vs of the sustain pulse Sus.

Since the erase pulse fails to be supplied in the prior sub-field, a sustain discharge occurs between the scan and sustain electrodes Y and Z for the set-up period once a voltage difference amounting to the voltage level Vs of the sustain pulse Sus is generated between the scan and sustain electrodes Y and Z for the set-up period.

In this case, in order to prevent a sustain discharge that may occur for the set-up period, the slope of the ramp-up pulse Zramp applied to the sustain electrode Z is increased greater than that of the ramp-up reset pulse. Hence, a value attained by subtracting the peak voltage Vd of the ramp-up pulse Zramp applied to the sustain electrode Z from the peak voltage Vr of the ramp-up reset pulse is lower than the voltage level Vs of the sustain pulse Sus. Therefore, there occurs no voltage difference between the scan and sustain electrodes Y and Z as much as the voltage level Vs of the sustain pulse Sus.

Since an accumulated amount of wall charges formed between the sustain and scan electrodes Z and Y by the ramp-up pulse Zramp applied to the sustain electrode Z is formed relatively smaller than that between the scan and address electrodes Y and X, a surface discharge that may occur between the sustain and scan electrodes Z and Y can be suppressed.

And, the DC voltage applied to the sustain electrode Z from the set-down period continuously maintains its voltage level Vz for an address period.

The DC voltage Vd applied to the sustain electrode Z from the set-down period is continuously applied to the sustain electrodes Z for the address period, and a negative(−) scan pulse Scan is sequentially applied to the scan electrodes Y while the DC voltage Vz is applied to the sustain electrodes Z. Moreover, a positive(+) data pulse Data synchronized with the negative(−) scan pulse Scan is applied to the address electrodes X. Once the scan and data pulses Scan and Data are applied thereto, wall charges are accumulated enough to bring about an address discharge. Specifically, a voltage difference between the scan and data pulses Scan and Data is added to a voltage raised by the wall charges generated for the reset period, whereby the address discharge occurs in the discharge cell supplied with the data pulse Data In this case, since a remaining amount of the accumulated wall charges between the sustain and scan electrodes Z and Y, as mentioned in the foregoing description, is small, there occurs no discharge or a weak discharge.

The above-described drive scheme is applied to each of the subsequent sub-fields. Specifically, the erase pulse fails to be supplied after completion of a sustain discharge of the second sub-field SF2 as well.

Figure 14:
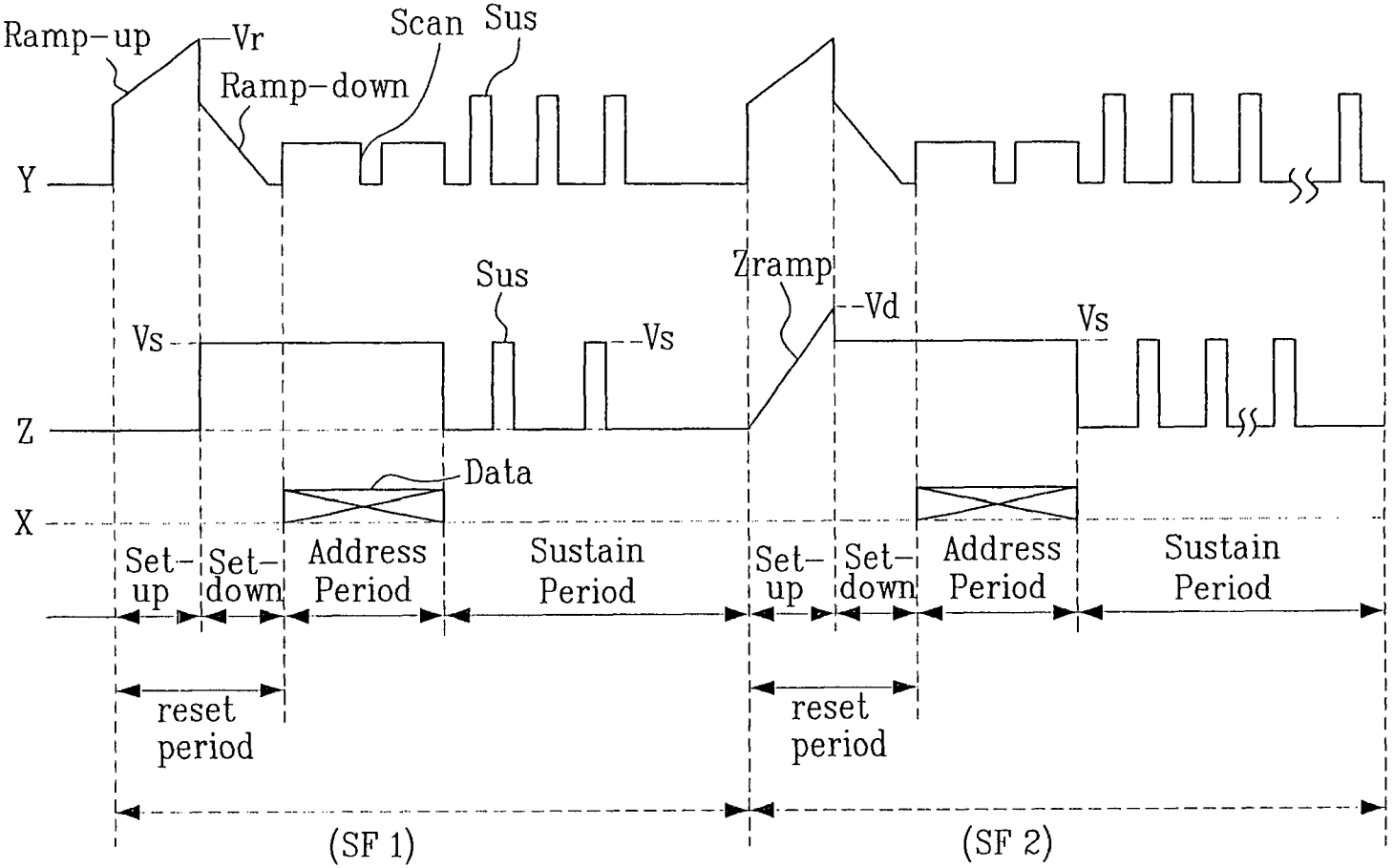
FIG. 14 illustrates a method of driving a PDP according to a tenth embodiment of the present invention.

FIG. 14 illustrates a method of driving a PDP according to a tenth embodiment of the present invention, in which a pulse Zramp of a ramp-up waveform synchronized with a ramp-up reset pulse for set-up periods of the entire sub-fields SF2~except the first sub-field SF1 is applied to a sustain electrode Z to reduce a voltage difference between the scan and sustain electrodes Y and Z. The tenth embodiment of the present invention differs from the seventh or eighth embodiment of the present invention in that a peak voltage level Vd of the ramp-up pulse Zramp for reducing the voltage difference is greater than a voltage level Vs of a sustain pulse Sus, the ramp-up pulse Zramp is not applied to the first sub-field SF1, and an erase pulse for erasing wall charges remaining in cells of the entire screen is not supplied. Compared to the ninth embodiment of the present invention, the tenth embodiment of the present invention differs from the ninth in that a level of a DC voltage supplied for a set-down period and an address period of the second sub-field SF2 is lowered to the voltage level Vs of the sustain pulse Sus to maintain.

Referring to FIG. 14, the PDP driving method according to the tenth embodiment of the present invention follows the same scheme explained through FIG. 2 except that an erase pulse is not applied to a sustain electrode Z in a first sub-field SF1. Hence, a drive scheme for the first sub-field SF1 is skipped in this description.

When the first sub-field SF1 is terminated, a state that the wall charges formed in the discharge cells are not removed, as mentioned in the ninth embodiment of the present invention, continues to a second sub-field SF2.

A drive scheme of a second sub-field SF2 according to the tenth embodiment of the present invention is explained as follows.

First of all, for a set-up period of the second sub-field SF2, a ramp-up reset pulse is applied to a scan electrode Y and a ramp-up pulse Zramp synchronized with the ramp-up reset pulse is applied to a sustain electrode Z. The ramp-up pulse Zramp applied to a sustain electrode Z has a waveform ascending from a base voltage to a peak voltage Vd higher than a voltage Vs of a sustain pulse Sus applied for a sustain period.

A ramp-down reset pulse is applied to the scan electrode Y for a set-down period, and a positive(+) DC voltage is applied to the sustain electrode Z while the ramp-down reset pulse is applied to the scan electrodes Y. Namely, the positive(+) DC voltage starts being applied to the sustain electrodes Z from a time point that the ramp-down reset pulse is applied to the scan electrode Y and continues being applied thereto until reaching a negative(−) reset-down voltage. The positive(+) DC voltage has the same voltage level Vs of the sustain pulse Sus, which is different from the ninth embodiment of the present invention.

The ramp-up reset pulse applied to the entire scan electrodes Y for the set-up period ascends to a peak voltage Vr higher than the voltage level Vs of the sustain pulse Sus applied for a sustain period. The ramp-up pulse Zramp applied to the sustain electrode Z has a slope greater than that of the ramp-up reset pulse and has a peak voltage higher than the voltage level Vs of the sustain pulse Sus.

In order to prevent a sustain discharge that may occur for the set-up period, the slope of the ramp-up pulse Zramp applied to the sustain electrode Z is increased greater than that of the ramp-up reset pulse. Therefore, there occurs no voltage difference between the scan and sustain electrodes Y and Z as much as the voltage level Vs of the sustain pulse Sus, thereby enabling to suppress a surface discharge that may occur between the sustain and scan electrodes Z and Y.

And, the DC voltage applied to the sustain electrode Z from the set-down period continuously maintains its voltage level Vs for an address period.

The DC voltage Vs applied to the sustain electrode Z from the set-down period is continuously applied to the sustain electrodes Z for the address period, and a negative(−) scan pulse Scan is sequentially applied to the scan electrodes Y while the DC voltage Vs is applied to the sustain electrodes Z. Moreover, a positive(+) data pulse Data synchronized with the negative(−) scan pulse Scan is applied to the address electrodes X. Once the scan and data pulses Scan and Data are applied thereto, wall charges are accumulated enough to bring about an address discharge. Specifically, a voltage difference between the scan and data pulses Scan and Data is added to a voltage raised by the wall charges generated for the reset period, whereby the address discharge occurs in the discharge cell supplied with the data pulse Data In this case, since a remaining amount of the accumulated wall charges between the sustain and scan electrodes Z and Y, as mentioned in the foregoing description, is small, there occurs no discharge or a weak discharge.

The above-described drive scheme is applied to each of the subsequent sub-fields. Specifically, the erase pulse fails to be supplied after completion of a sustain discharge of the second sub-field SF2 as well.

Figure 15:
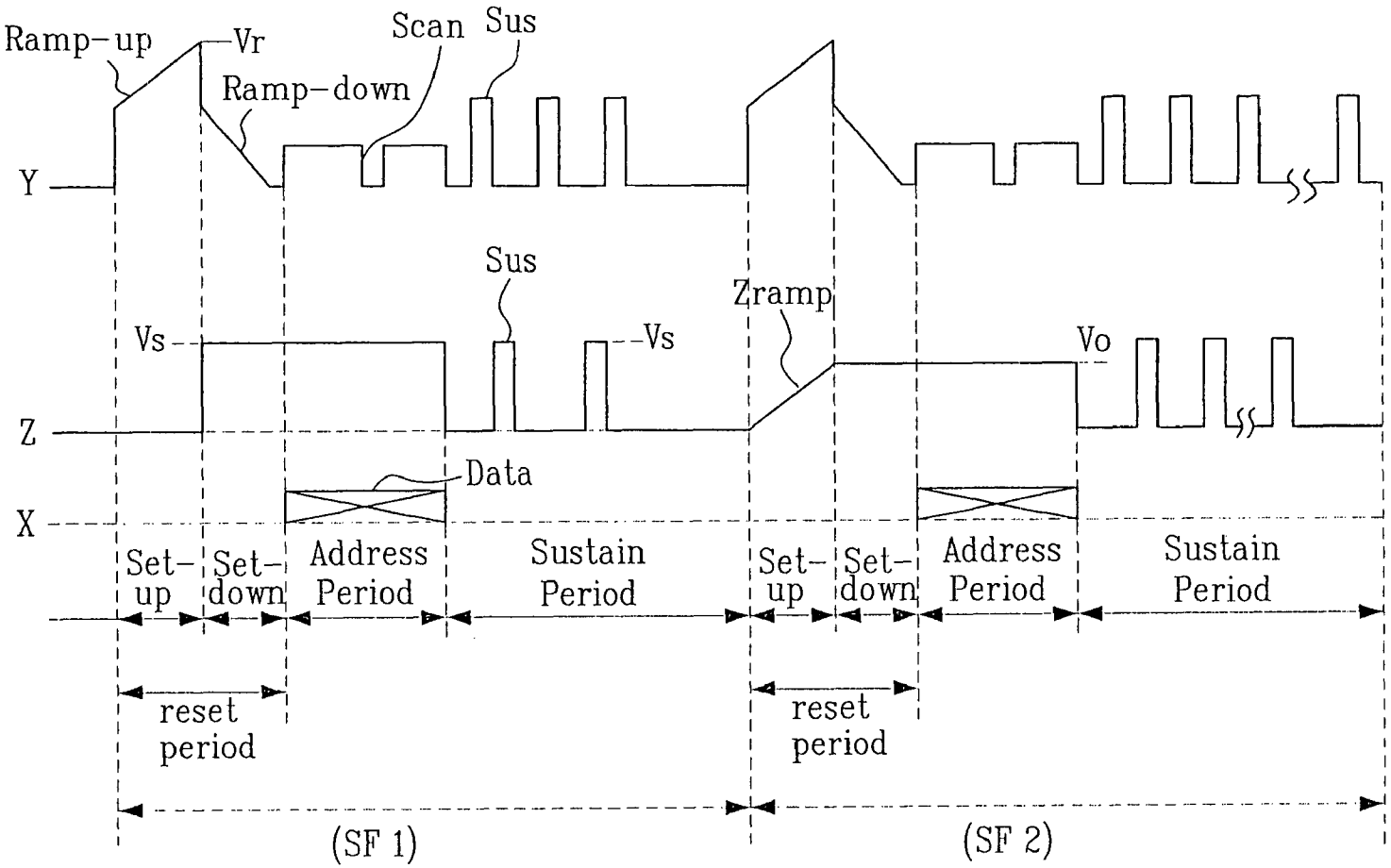
FIG. 15 illustrates a method of driving a PDP according to an eleventh embodiment of the present invention.

FIG. 15 illustrates a method of driving a PDP according to an eleventh embodiment of the present invention, in which a pulse Zramp of a ramp-up waveform synchronized with a ramp-up reset pulse for set-up periods of the entire sub-fields except the first sub-field SF1 is applied to a sustain electrode Z to reduce a voltage difference between the scan and sustain electrodes Y and Z. The eleventh embodiment of the present invention differs from the ninth embodiment of the present invention in that the pulse Zramp synchronized with a ramp-up reset pulse has the ramp-up waveform ascending to a peak voltage Vo lower than a voltage level Vs of a sustain pulse Sus and the peak voltage Vo is maintained for a set-down period and an address period.

Referring to FIG. 15, the PDP driving method according to the eleventh embodiment of the present invention follows the same scheme explained through FIG. 2 except that an erase pulse is not applied to a sustain electrode Z in a first sub-field SF1. Hence, a drive scheme for the first sub-field SF1 is skipped in this description.

When the first sub-field SF1 is terminated, a state that the wall charges formed in the discharge cells are not removed, as mentioned in the ninth embodiment of the present invention, continues to a second sub-field SF2.

Specifically in the eleventh embodiment of the present invention, a time for supplying the erase pulse for a sustain period of the first sub-field is delayed to use as the set-up period of the second sub-field, which is explained in detail as follows.

A drive scheme of a second sub-field SF2 according to the eleventh embodiment of the present invention is explained as follows.

First of all, for a set-up period of the second sub-field SF2, a ramp-up reset pulse is applied to a scan electrode Y. And, a ramp-up pulse Zramp synchronized with the ramp-up reset pulse is applied to a sustain electrode Z. These two pulses are supplied as a last sustain pulse that is supplied as an erase pulse for a sustain period of the first sub-field SF1. In other words, a last sustain pulse of the ramp-up waveform that will be supplied after a sustain discharge of the first sub-field SF1 is applied to each of the scan and sustain electrodes Y and Z.

Hence, the ramp-up reset pulse applied to the scan electrode Y and the ramp-up pulse Zramp applied to the sustain electrode Z are synchronized with each other to have the same waveform ascending with the same slope.

The ramp-up reset pulse applied to the scan electrode Y has a waveform ascending from the voltage level Vs of the sustain pulse to a peak voltage Vr higher than the voltage level Vs of the sustain pulse Sus. And, the ramp-up pulse Zramp applied to the sustain electrode Z has a waveform ascending from a base voltage to a peak voltage Vo lower than the voltage level Vs of the sustain pulse Sus applied for a sustain period.

Once the ramp-up reset pulse is applied to the scan electrode Y, a discharge may occur between the scan and sustain electrodes Z. Yet, there occurs no sustain discharge between the scan and sustain electrodes Y and Z since the ramp-up pulse Zramp having the same slope of the ramp-up reset pulse applied to the scan electrode T is applied to the sustain electrode Z.

A ramp-down reset pulse is applied to the scan electrode Y for a set-down period of the second sub-field SF2, and a positive(+) DC voltage is applied to the sustain electrode Z while the ramp-down reset pulse is applied to the scan electrodes Y. Namely, the positive(+) DC voltage starts being applied to the sustain electrodes Z from a time point that the ramp-down reset pulse is applied to the scan electrode Y and continues being applied thereto until reaching a negative(−) reset-down voltage. The positive(+) DC voltage has a voltage level Vo lower than the voltage Vs of the sustain pulse Sus, which is different from the ninth embodiment of the present invention. And, the voltage level Vo is attained by subtracting the voltage Vs of the sustain pulse Sus from the peak voltage Vr of the ramp-down reset pulse.

The ramp-up reset pulse applied to the entire scan electrodes Y for the set-down period has a waveform descending from the positive voltage level lower than the peak voltage Vr of the ramp-up reset pulse to the negative reset-down voltage.

The DC voltage Vo supplied from the set-down period is continuously applied to the sustain electrodes Z for the address period, and a negative(−) scan pulse Scan is sequentially applied to the scan electrodes Y while the DC voltage Vo is applied to the sustain electrodes Z. Moreover, a positive(+) data pulse Data synchronized with the negative(−) scan pulse Scan is applied to the address electrodes X. Once the scan and data pulses Scan and Data are applied thereto, wall charges are accumulated enough to bring about an address discharge. Specifically, a voltage difference between the scan and data pulses Scan and Data is added to a voltage raised by the wall charges generated for the reset period, whereby the address discharge occurs in the discharge cell supplied with the data pulse Data In this case, since a remaining amount of the accumulated wall charges between the sustain and scan electrodes Z and Y is small, there occurs no discharge or a weak discharge.

The above-described drive scheme is applied to each of the subsequent sub-fields. Specifically, the erase pulse fails to be supplied after completion of a sustain discharge of the second sub-field SF2 as well.

Figure 16:
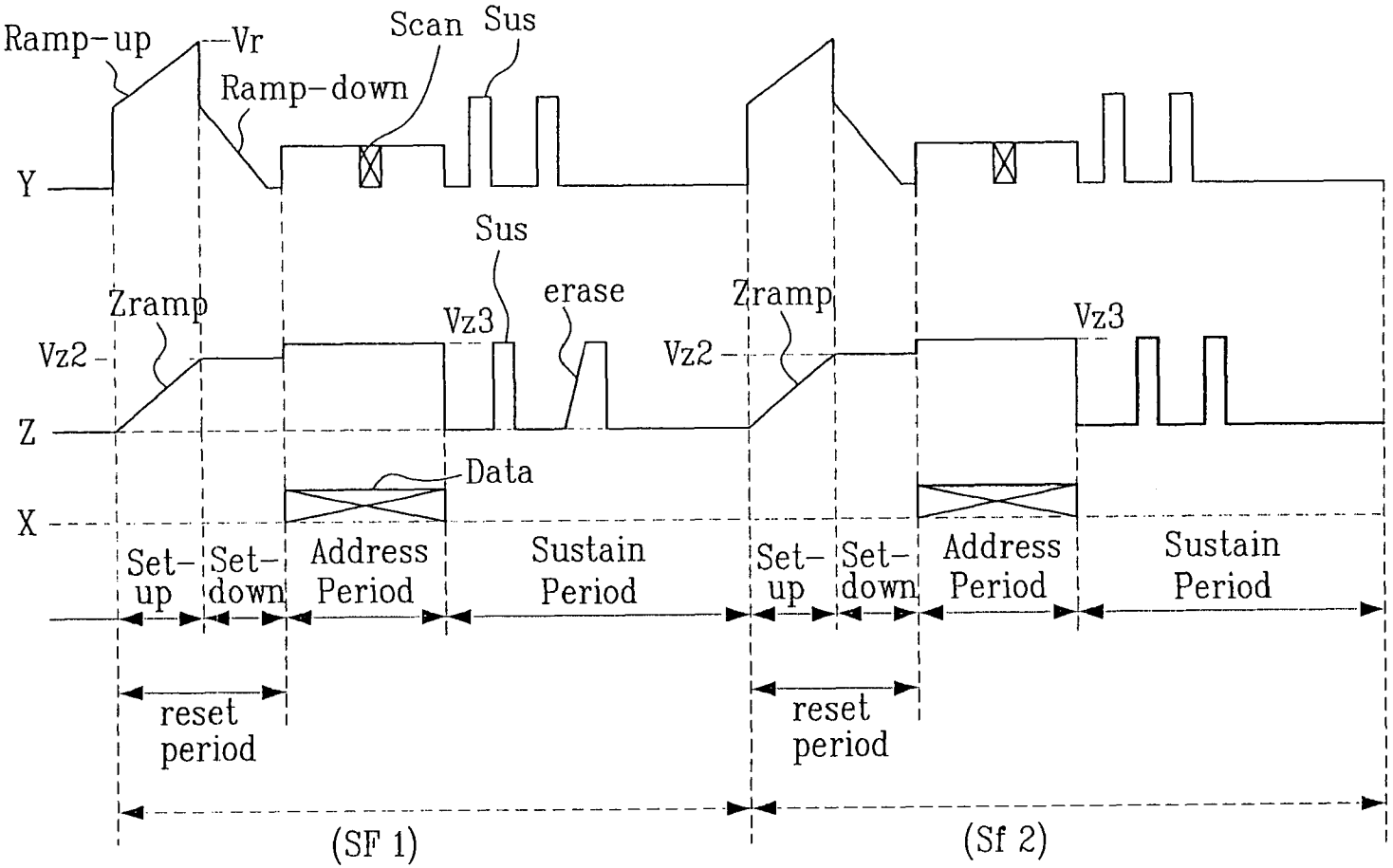
FIG. 16 illustrates a method of driving a PDP according to a twelfth embodiment of the present invention.

FIG. 16 illustrates a method of driving a PDP according to a twelfth embodiment of the present invention, in which a pulse Zramp of a ramp-up waveform synchronized with a ramp-up reset pulse for a set-up period of each sub-field is applied to a sustain electrode Z to reduce a voltage difference between the scan and sustain electrodes Y and Z. The twelfth embodiment of the present invention differs from the seventh embodiment of the present invention in FIG. 11 in that the ramp-up pulse Zramp applied to the sustain electrode Z has a waveform ascending to a peak voltage Vz2 of a level lower than a voltage level Vs of a sustain pulse Sus, the peal voltage level Vz2 of the ramp-up pulse Zramp lower than the voltage level Vs of the sustain pulse Sus is maintained for a set-down period, and a voltage having a level different from the voltage level supplied for the set-down period is supplied for an address period.

Referring to FIG. 16, for a set-up period of each sub-field, a ramp-up reset pulse is applied to a scan electrode Y and a ramp-up pulse Zramp synchronized with the ramp-up reset pulse is applied to a sustain electrode Z.

The ramp-up reset pulse applied to the entire scan electrodes Y has a waveform ascending to a peak voltage Vr higher than a voltage level Vs of a sustain pulse Sus applied to the sustain electrode Z for a sustain period. And, the ramp-up pulse Zramp applied to the sustain electrode Z has a waveform ascending from a base voltage to a peak level Vz2 lower than the voltage level Vs of the sustain pulse Sus. The ramp-up pulse Zramp decreases a ramp slope of the ramp-up reset pulse, thereby enabling to reduce a discharge between the scan and sustain electrodes Y and Z. Moreover, the voltage difference between the scan and sustain electrodes Y and Z is lowered by the ramp-up pulse applied to the sustain electrode Z, whereby an accumulated amount of wall charges formed between the sustain and scan electrodes Z and Y is formed relatively smaller than that between the scan and address electrodes Y and X.

A ramp-down reset pulse is applied to the scan electrode Y for a set-down period, and a positive(+) DC voltage Vz2 is applied to the sustain electrode Z while the ramp-down reset pulse is applied to the scan electrodes Y. Namely, the positive (+) DC voltage Vz2 starts being applied to the sustain electrodes Z from a time point that the ramp-down reset pulse is applied to the scan electrode Y and continues being applied thereto until reaching a negative(−) reset-down voltage. The positive(+) DC voltage applied to the sustain electrode Z has a waveform having a voltage level Vz2 lower than the voltage level Vs of the sustain pulse Sus (Vs>Vz2).

The DC voltage applied to the sustain electrode Z for the set-down period maintains the level lower than the voltage level Vs of the sustain pulse Sus, whereby the address discharge is generated more stably. Specifically, since an amount of the wall charges reduced by the ramp-down reset pulse applied to the scan electrode Y for the set-down period depends on the DC voltage applied to the sustain electrode Z, the DC voltage of the voltage level Vz2 lower than the voltage level Vs of the sustain pulse Sus is applied to the sustain electrode Z in order to reduce the amount of the wall charges reduced by the ramp-down reset pulse. Thus, as the DV voltage of the voltage level Vz2 lower than the voltage level Vs of the sustain pulse Sus is applied to the sustain electrode Z, the amount of the wall charges reduced by the ramp-down reset pulse is reduced to generate the address discharge more stably.

Hence, a set-up discharge is generated in discharge cells of the entire screen by the ramp-up reset pulse applied to the scan electrode Y. In this case, the ramp-up pulse Zramp applied to the sustain electrode Z reduces the voltage difference between the scan and sustain electrodes Y and Z. Since an accumulated amount of wall charges formed between the sustain and scan electrodes Z and Y is relatively smaller than that between the scan and address electrodes Y and X, a surface discharge that may occur between the sustain and scan electrodes Z and Y can be suppressed.

And, for an address period, the DC voltage maintains a voltage level Vz3 higher than the level Vz2 of the DC voltage applied to the sustain electrode Z for the set-down period. The DC voltage applied for the address period has the same voltage level Vz3(=Vs) of the voltage level Vs of the sustain pulse Sus. The reason why the DC voltage shifted to the voltage level Vs of the sustain pulse Sus for the address period is explained in the third embodiment according to the present invention.

A negative(−) scan pulse Scan is sequentially applied to the scan electrodes Y while the DC voltage Vz3 is applied to the sustain electrodes Z for the address period. Moreover, a positive(+) data pulse Data synchronized with the negative(−) scan pulse Scan is applied to the address electrodes X. Once the scan and data pulses Scan and Data are applied thereto, wall charges are accumulated enough to bring about an address discharge. Specifically, a voltage difference between the scan and data pulses Scan and Data is added to a voltage raised by the wall charges generated for the reset period, whereby the address discharge occurs in the discharge cell supplied with the data pulse Data. In this case, since a remaining amount of the accumulated wall charges between the sustain and scan electrodes Z and Y is small, there occurs no discharge or a weak discharge.

The above-described drive scheme is applied to each of the subsequent sub-fields.

Figure 17:
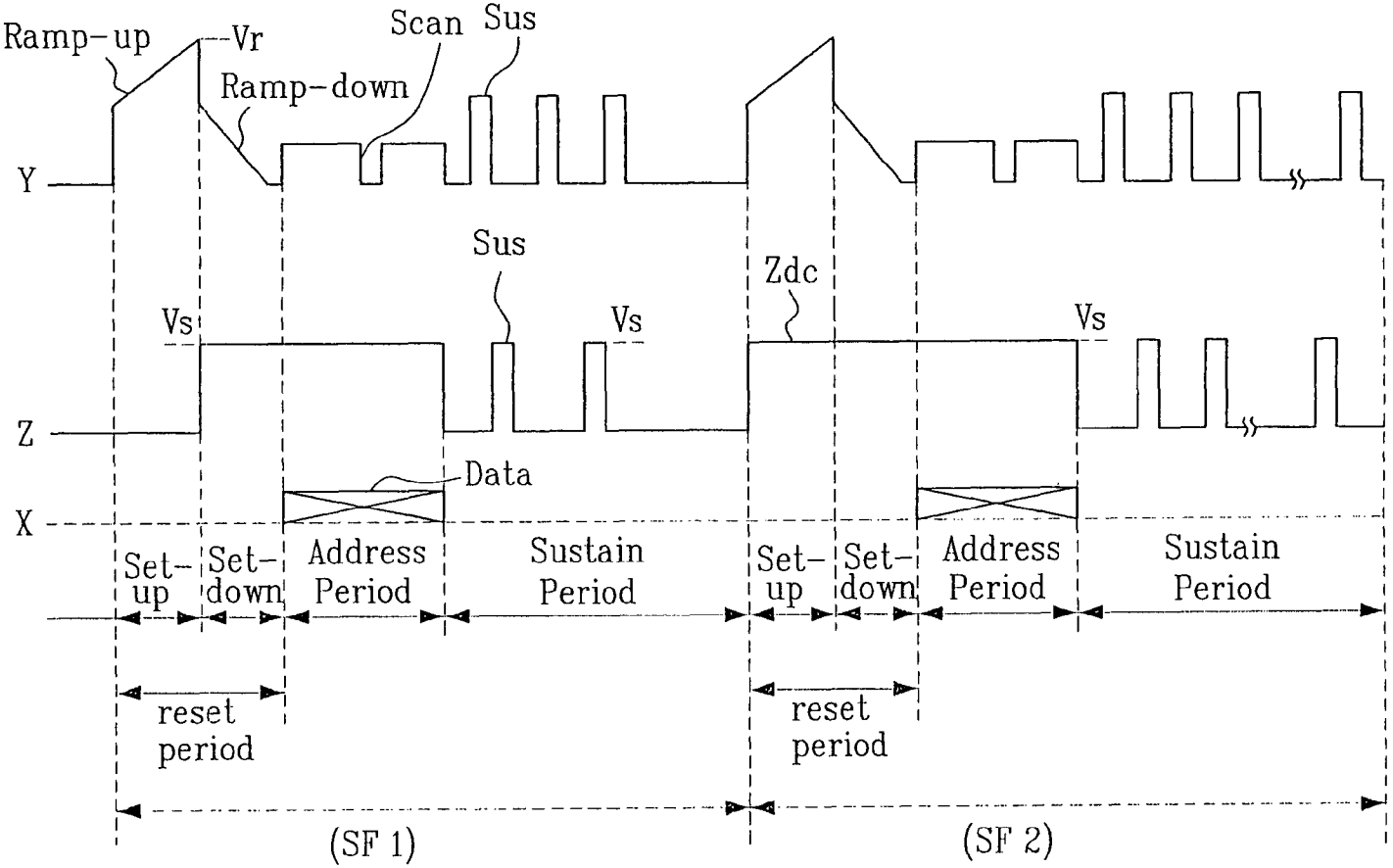
FIG. 17 illustrates a method of driving a PDP according to a thirteenth embodiment of the present invention.

FIG. 17 illustrates a method of driving a PDP according to a thirteenth embodiment of the present invention, in which a DC voltage Zdc is applied to a sustain electrode Z for set-up periods of the entire sub-fields except the first sub-field SF1 to reduce a voltage difference between the scan and sustain electrodes Y and Z. Specifically, a level of the DC voltage Zdc for reducing the voltage difference is equal to a voltage level Vs of a sustain pulse Sus.

In the thirteenth embodiment of the present invention, an erase pulse for erasing wall charges remaining in cells of the entire screen of each sub-field is not supplied.

Referring to FIG. 17, the PDP driving method according to the thirteenth embodiment of the present invention follows the same scheme explained through FIG. 2 except that an erase pulse is not applied to a sustain electrode Z in a first sub-field SF1. Hence, a drive scheme for the first sub-field SF1 is skipped in this description.

When the first sub-field SF1 is terminated, a state that the wall charges formed in the discharge cells are not removed continues to a second sub-field SF2.

A drive scheme of a second sub-field SF2 according to the thirteenth embodiment of the present invention is explained as follows.

First of all, for a set-up period of the second sub-field SF2, a ramp-up reset pulse is applied to a scan electrode Y and a DC voltage Zdc is applied to a sustain electrode Z. The DC voltage Zdc applied to the sustain electrode Z has a DC waveform having the same voltage level Vs of a sustain pulse applied for a sustain period.

The ramp-up reset pulse applied to the entire scan electrodes Y for the set-up period ascends to a peak voltage Vr higher than a voltage Vs of a sustain pulse Sus applied for a sustain period. And, the DC voltage Zdc applied to the sustain electrode Z has the voltage level Vs of the sustain pulse Sus lower than the ramp-up reset pulse.

Since an accumulated amount of wall charges formed between the sustain and scan electrodes Z and Y by the Dc voltage Zdc applied to the sustain electrode Z is formed relatively smaller than that between the scan and address electrodes Y and X, a surface discharge that may occur between the sustain and scan electrodes Z and Y can be suppressed.

A ramp-down reset pulse is applied to the scan electrode Y for a set-down period, and a positive(+) DC voltage Zdc having the same voltage level Vs is applied to the sustain electrode Z while the ramp-down reset pulse is applied to the scan electrodes Y.

And, the DC voltage Zdc applied to the sustain electrode Z from the set-down period continuously maintains its voltage level Vs for an address period.

The DC voltage Zdc applied to the sustain electrode Z from the set-down period is continuously applied to the sustain electrodes Z for the address period, and a negative(−) scan pulse Scan is sequentially applied to the scan electrodes Y while the DC voltage Vz is applied to the sustain electrodes Z. Moreover, a positive(+) data pulse Data synchronized with the negative(−) scan pulse Scan is applied to the address electrodes X. Once the scan and data pulses Scan and Data are applied thereto, wall charges are accumulated enough to bring about an address discharge. Specifically, a voltage difference between the scan and data pulses Scan and Data is added to a voltage raised by the wall charges generated for the reset period, whereby the address discharge occurs in the discharge cell supplied with the data pulse Data In this case, since a remaining amount of the accumulated wall charges between the sustain and scan electrodes Z and Y, as mentioned in the foregoing description, is small, there occurs no discharge or a weak discharge.

The above-described drive scheme is applied to each of the subsequent sub-fields. Specifically, the erase pulse fails to be supplied after completion of a sustain discharge of the second sub-field SF2 as well.

Figure 18:
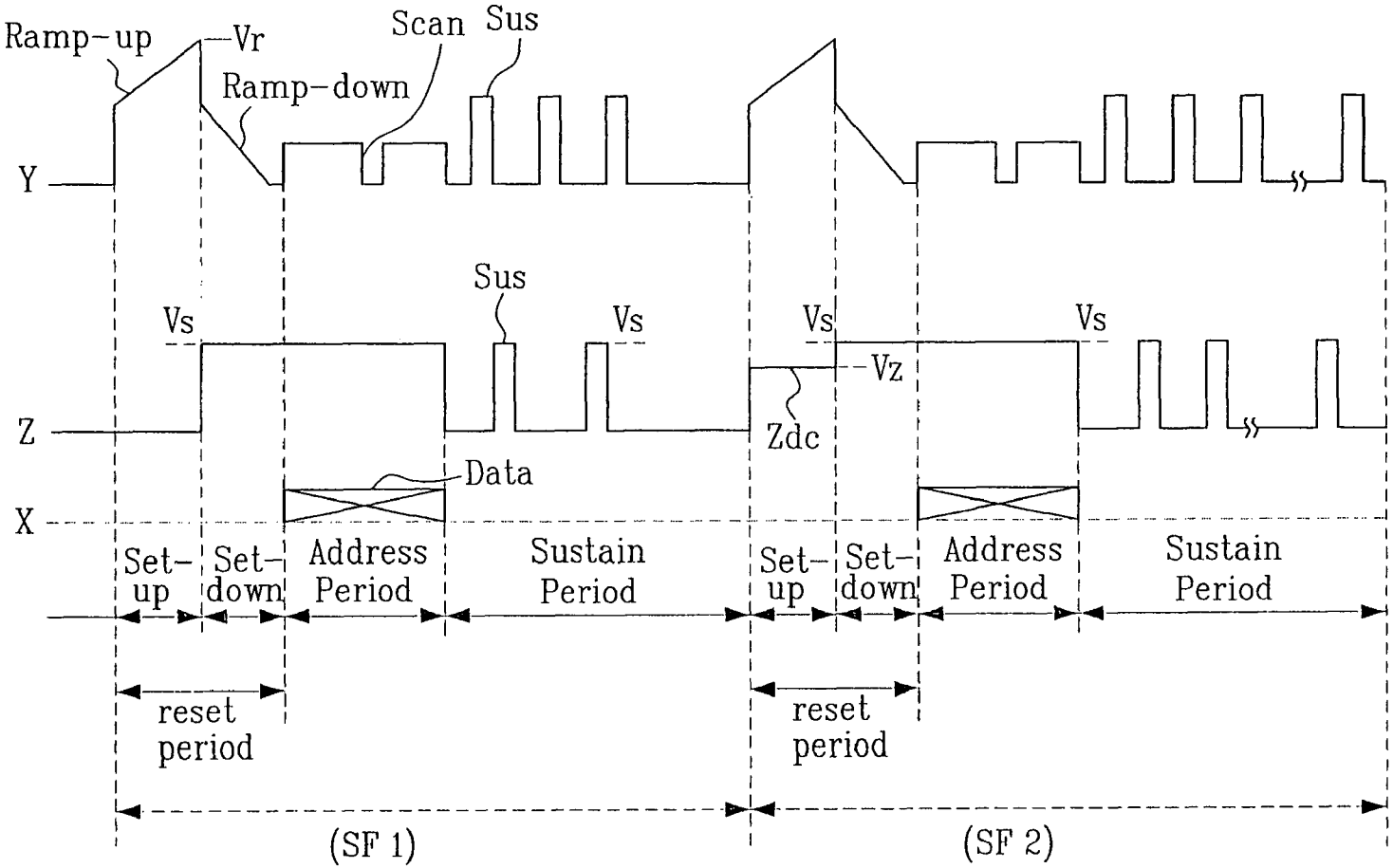
FIG. 18 illustrates a method of driving a PDP according to a fourteenth embodiment of the present invention.

FIG. 18 illustrates a method of driving a PDP according to a fourteenth embodiment of the present invention, in which a DC voltage Zdc is applied to a sustain electrode Z for set-up periods of the entire sub-fields except the first sub-field SF1 to reduce a voltage difference between the scan and sustain electrodes Y and Z. Specifically, a level of the DC voltage Zdc for reducing the voltage difference has a level Vz lower than a voltage level Vs of a sustain pulse Sus, which is different from the thirteenth embodiment according to the present invention in FIG. 17.

In the fourteenth embodiment of the present invention, an erase pulse for erasing wall charges remaining in cells of the entire screen of each sub-field is not supplied.

Referring to FIG. 18, the PDP driving method according to the fourteenth embodiment of the present invention follows the same scheme explained through FIG. 2 except that an erase pulse is not applied to a sustain electrode Z in a first sub-field SF1. Hence, a drive scheme for the first sub-field SF1 is skipped in this description.

When the first sub-field SF1 is terminated, a state that the wall charges formed in the discharge cells are not removed continues to a second sub-field SF2.

A drive scheme of a second sub-field SF2 according to the fourteenth embodiment of the present invention is explained as follows.

First of all, for a set-up period of the second sub-field SF2, a ramp-up reset pulse is applied to a scan electrode Y and a DC voltage Zdc is applied to a sustain electrode Z. The DC voltage Zdc applied to the sustain electrode Z has a DC waveform of a level lower than a voltage level Vs of a sustain pulse Sus applied for a sustain period.

The ramp-up reset pulse applied to the entire scan electrodes Y for the set-up period ascends to a peak voltage Vr higher than the voltage level Vs of the sustain pulse Sus applied for the sustain period. Hence, the DC voltage Zdc applied to the sustain electrode Z has the voltage level lower than the ramp-up reset pulse.

Since an accumulated amount of wall charges formed between the sustain and scan electrodes Z and Y by the Dc voltage Zdc applied to the sustain electrode Z is formed relatively smaller than that between the scan and address electrodes Y and X, a surface discharge that may occur between the sustain and scan electrodes Z and Y can be suppressed.

A ramp-down reset pulse is applied to the scan electrode Y for a set-down period, and a DC voltage having a level Vs higher than that of a positive(+) DC voltage Zdc supplied for the set-up period is applied to the sustain electrode Z while the ramp-down reset pulse is applied to the scan electrodes Y.

And, the DC voltage applied to the sustain electrode Z from the set-down period continuously maintains its voltage level Vs for an address period.

The DC voltage supplied from the set-down period is continuously applied to the sustain electrodes Z for the address period, and a negative(−) scan pulse Scan is sequentially applied to the scan electrodes Y while the DC voltage is applied to the sustain electrodes Z. Moreover, a positive(+) data pulse Data synchronized with the negative(−) scan pulse Scan is applied to the address electrodes X. Once the scan and data pulses Scan and Data are applied thereto, a voltage difference between the scan and data pulses Scan and Data is added to a voltage raised by the wall charges generated for the reset period, whereby the address discharge occurs in the discharge cell supplied with the data pulse Data In this case, since a remaining amount of the accumulated wall charges between the sustain and scan electrodes Z and Y, as mentioned in the foregoing description, is small, there occurs no discharge or a weak discharge.

The above-described drive scheme is applied to each of the subsequent sub-fields. Specifically, the erase pulse fails to be supplied after completion of a sustain discharge of the second sub-field SF2 as well.

Figure 19:
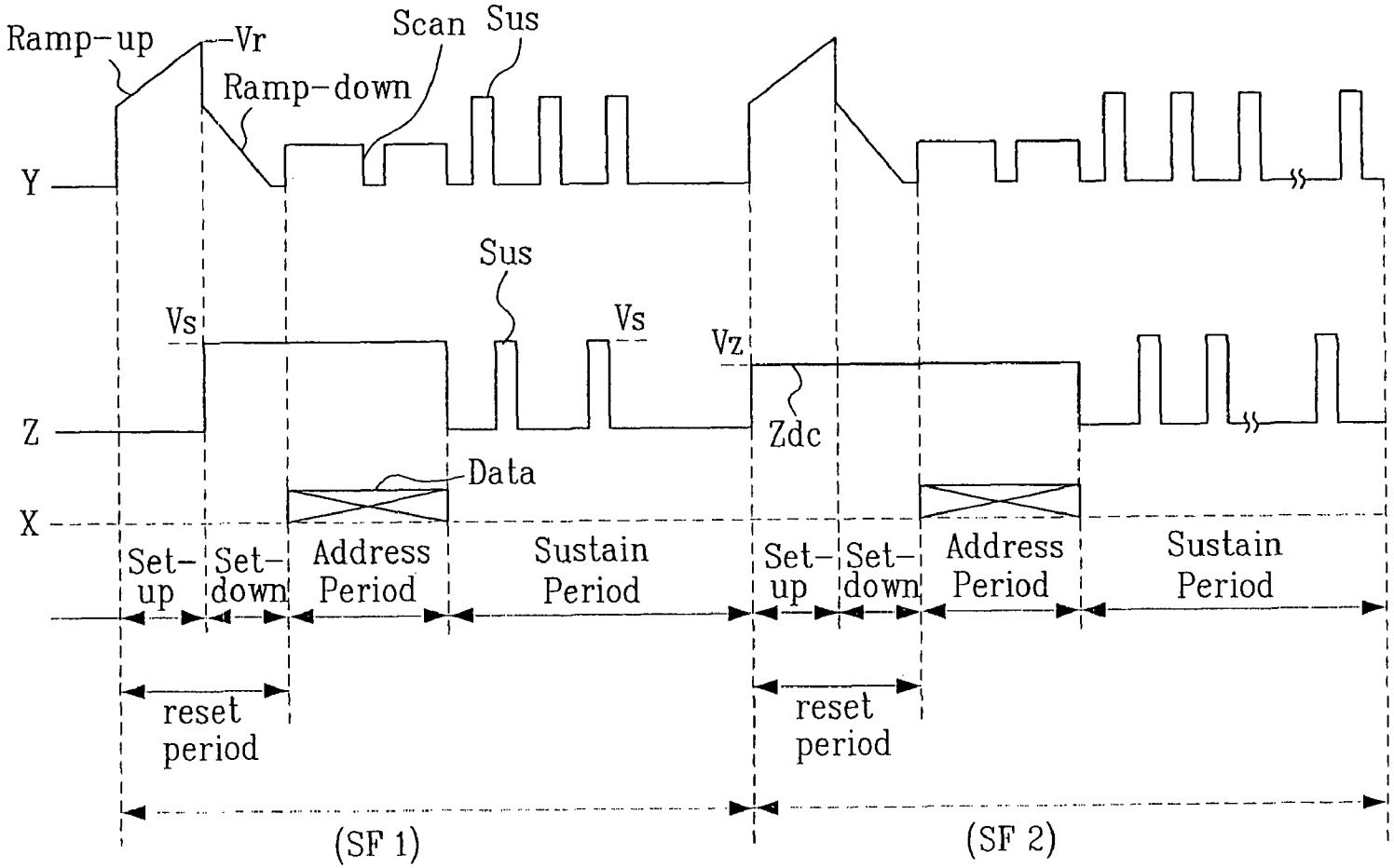
FIG. 19 illustrates a method of driving a PDP according to a fifteenth embodiment of the present invention.

FIG. 19 illustrates a method of driving a PDP according to a fifteenth embodiment of the present invention, in which a DC voltage Zdc is applied to a sustain electrode Z for set-up periods of the entire sub-fields except the first sub-field SF1 to reduce a voltage difference between the scan and sustain electrodes Y and Z. Specifically, a level of the DC voltage Zdc for reducing the voltage difference has a level Vz lower than a voltage level Vs of a sustain pulse Sus, which is the same as the fourteenth embodiment according to the present invention in FIG. 18. Yet, the fifteenth embodiment according to the present invention differs from the fourteenth in FIG. 18 in that the DC voltage having the level Vz lower than the voltage level Vs of the sustain pulse Sus is continuously maintained for a set-down period and an address period.

In the fifteenth embodiment of the present invention, an erase pulse for erasing wall charges remaining in cells of the entire screen of each sub-field is not supplied.

Referring to FIG. 19, the PDP driving method according to the fourteenth embodiment of the present invention follows the same scheme explained through FIG. 2 except that an erase pulse is not applied to a sustain electrode Z in a first sub-field SF1. Hence, a drive scheme for the first sub-field SF1 is skipped in this description.

When the first sub-field SF1 is terminated, a state that the wall charges formed in the discharge cells are not removed continues to a second sub-field SF2.

A drive scheme of a second sub-field SF2 according to the fifteenth embodiment of the present invention is explained as follows.

First of all, for a set-up period of the second sub-field SF2, a ramp-up reset pulse is applied to a scan electrode Y and a DC voltage Zdc is applied to a sustain electrode Z. The DC voltage Zdc applied to the sustain electrode Z has a DC waveform of a level lower than a voltage level Vs of a sustain pulse Sus applied for a sustain period.

The ramp-up reset pulse applied to the entire scan electrodes Y for the set-up period ascends to a peak voltage Vr higher than the voltage level Vs of the sustain pulse Sus applied for the sustain period. Hence, the DC voltage Zdc applied to the sustain electrode Z has the voltage level lower than the ramp-up reset pulse.

Since an accumulated amount of wall charges formed between the sustain and scan electrodes Z and Y by the Dc voltage Zdc applied to the sustain electrode Z is formed relatively smaller than that between the scan and address electrodes Y and X, a surface discharge that may occur between the sustain and scan electrodes Z and Y can be suppressed.

A ramp-down reset pulse is applied to the scan electrode Y for a set-down period, and a DC voltage having a level Vz equal to that of a positive(+) DC voltage Zdc supplied for the set-up period is applied to the sustain electrode Z while the ramp-down reset pulse is applied to the scan electrodes Y.

And, the DC voltage applied to the sustain electrode Z from the set-down period continuously maintains the voltage level Vz for an address period.

The DC voltage supplied from the set-down period is continuously applied to the sustain electrodes Z for the address period, and a negative(−) scan pulse Scan is sequentially applied to the scan electrodes Y while the DC voltage is applied to the sustain electrodes Z. Moreover, a positive(+) data pulse Data synchronized with the negative(−) scan pulse Scan is applied to the address electrodes X. Once the scan and data pulses Scan and Data are applied thereto, a voltage difference between the scan and data pulses Scan and Data is added to a voltage raised by the wall charges generated for the reset period, whereby the address discharge occurs in the discharge cell supplied with the data pulse Data In this case, since a remaining amount of the accumulated wall charges between the sustain and scan electrodes Z and Y, as mentioned in the foregoing description, is small, there occurs no discharge or a weak discharge.

The above-described drive scheme is applied to each of the subsequent sub-fields. Specifically, the erase pulse fails to be supplied after completion of a sustain discharge of the second sub-field SF2 as well.

Accordingly, the method of driving the PDP according to the present invention has the following effects or advantages.

First of all, the pulse decreasing the voltage difference between the scan and sustain electrodes Y and Z is applied to the sustain electrode Z for the set-up period, thereby suppressing the discharge that may occur between the scan and sustain electrodes Y and Z for the reset period.

Therefore, the present invention minimizes the amount of light caused by the discharge generated between the scan and sustain electrodes Y and Z, thereby enabling to improve the overall contrast characteristic of the PDP.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A method for driving a plasma display panel based on a frame having a plurality of sub-fields, the method comprising:

applying a scan electrode waveform to a scan electrode during a reset period of at least one sub-field, the scan electrode waveform including a first ramp-up section wherein a first voltage level increases, and a ramp-down section wherein a second voltage level decreases; and applying a sustain electrode waveform to a sustain electrode during the reset period of the at least one sub-field, the sustain electrode waveform including a second ramp-up section wherein a third voltage level increases during the first ramp-up section of the scan electrode waveform, and a first flat section wherein a fourth voltage level is maintained at a constant level during the ramp-down section of the scan electrode waveform, wherein the first voltage level of the scan electrode waveform and the third voltage level of the sustain voltage waveform increase at a starting point of the reset period, at a same time.

2. The method of claim 1, wherein the fourth voltage level of the sustain electrode waveform is different from a sustain discharge voltage level of a sustain signal provided to the sustain electrode during a sustain period of the at least one sub-field.

3. The method of claim 2, wherein the fourth voltage level of the sustain electrode waveform is lower than the sustain discharge voltage level.

4. The method of claim 1, wherein the fourth voltage level of the sustain electrode waveform is different from an address discharge voltage level provided to the sustain electrode during an address period of the at least one sub-field.

5. The method of claim 4, wherein the fourth voltage level of the sustain electrode waveform is lower than the address discharge voltage level.

6. The method of claim 1, wherein a highest voltage level of the third voltage level is lower than the address discharge voltage level provided to the sustain electrode during an address period of the at least one sub-field.

7. The method of claim 1, wherein an application period of the first ramp-up section of the scan electrode waveform and an application period of the second ramp-up section of the sustain electrode are substantially identical to one another.

8. The method of claim 1, wherein the sustain electrode waveform is provided during the reset period of a prescribed number of sub-fields within the frame.

9. The method of claim 8, wherein the prescribed number of the sub fields within the frame is more than a remaining number of the sub fields within the frame.

10. The method of claim 1, wherein the at least one sub-field is other than a first sub-field of the plurality of sub-fields.

11. The method of claim 1, wherein the first voltage level of the scan electrode waveform increases with a first slope and the third voltage level of the sustain voltage waveform increases with a second slope different from the first slope.

12. The method of claim 11, wherein the first slope is greater than the second slope.

13. The method of claim 11, wherein the first slope and the second slope rise at different acute angles.

14. The method of claim 11, wherein the first voltage level of the scan electrode waveform increases to a voltage different from the voltage to which the third voltage level of the sustain electrode waveform rises.

15. The method of claim 14, wherein the first voltage level of the scan electrode waveform increases to a voltage greater than the voltage to which the third voltage level of the sustain electrode waveform increases.

16. The method of claim 15, wherein the third voltage level of the sustain electrode waveform increases to substantially a sustain voltage.

17. The method of claim 15, wherein the third voltage level of the sustain electrode waveform increases to substantially a voltage below a sustain voltage.

* * * * *